US007066747B2

(12) United States Patent
Nagano et al.

(10) Patent No.: US 7,066,747 B2
(45) Date of Patent: Jun. 27, 2006

(54) CONNECTOR

(75) Inventors: Masao Nagano, Haibara-gun (JP); Takao Murakami, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/172,875

(22) Filed: Jul. 5, 2005

(65) Prior Publication Data

US 2006/0009058 A1 Jan. 12, 2006

(30) Foreign Application Priority Data

Jul. 8, 2004 (JP) ..... P2004-201745
Jul. 8, 2004 (JP) ..... P2004-201747

(51) Int. Cl.
*H01R 13/62* (2006.01)

(52) U.S. Cl. ..... 439/157

(58) Field of Classification Search ..... 439/157, 439/281, 282
See application file for complete search history.

(56) References Cited

U.S. PATENT DOCUMENTS 3,336,562 A * 8/1967 McCormick et al. ..... 439/155
4,637,674 A * 1/1987 Kobler ..... 439/371
5,352,126 A * 10/1994 Kuboshima et al. ..... 439/89
5,484,297 A * 1/1996 Takahashi et al. ..... 439/157
5,997,333 A * 12/1999 Konda et al. ..... 439/352
6,361,337 B1 * 3/2002 Kurimoto ..... 439/157
6,558,180 B1 * 5/2003 Nishimoto ..... 439/282
6,846,191 B1 * 1/2005 Hobbs et al. ..... 439/157
6,896,531 B1 * 5/2005 Bakker et al. ..... 439/140

FOREIGN PATENT DOCUMENTS

JP 2002-198127 A 7/2002

* cited by examiner

*Primary Examiner*—Tulsidas C. Patel
*Assistant Examiner*—Harshad C Patel
(74) *Attorney, Agent, or Firm*—Sughrue Mion, PLLC

(57) ABSTRACT

A connector includes a connector housing that has a first terminal and an inner housing that has a second terminal, and is configured to be fitted into the connector housing so that the second terminal is connected to the first terminal. A first slanting face is formed on an outer peripheral face of the inner housing. The connector housing have a chamber for receiving the inner housing therein when the inner housing is fitted into the connector housing. A first prevention face is formed on an inner peripheral face of the chamber. The first slanting face is surface-contacted with the first prevention face when the inner housing is completely fitted into the connector housing.

13 Claims, 13 Drawing Sheets

CONNECTOR

BACKGROUND OF THE INVENTION

This invention relates to a connector with a shaking prevention structure, and more particularly to a connector which has a structure for preventing a relative shaking movement between a male connector housing and a female connector housing in their mutually-fitted condition, thereby reducing wear of electrical contact portions of female and male terminals within the two connector housings.

FIGS. 13 and 14 show a related connector with a shaking prevention structure (see, for example, JP-A-2002-198127 (Pages 3 and 4, FIGS. 4 and 6)).

This connector 61 includes one connector 63 receiving female terminals 62, and the other connector 65 receiving male terminals 70. Shaking prevention projections 67 are formed integrally on an inner surface of an outer hood portion 66 of the one connector housing made of a synthetic resin, and an outer surface of the other connector housing 68 is held in close contact with the surfaces of the shaking prevention projections 67, thereby preventing the two connectors 63 and 65 from shaking relative to each other in a direction perpendicular to a direction of fitting of the two connectors (that is, a direction perpendicular to the connector fitting direction).

The one connector housing includes an inner housing 64 of the male type, and the hood portion 66 of a generally rectangular tubular shape disposed around the inner housing 64, and the female terminals 62 are received within the inner housing 64. The female terminals 62 are retained in a double manner by a front holder 69 made of a synthetic resin. A waterproof packing 71 is mounted on a proximal end portion of the inner housing 64. Each of the shaking prevention projections 67 has a generally rectangular or oblong shape.

The other connector housing 68 is inserted between the hood portion 66 and the inner housing 64. FIG. 14 shows a condition immediately before a completely-fitted condition is achieved. Simultaneously when the two connector housings are fitted together, each mating pair of female and male terminals 62 and 70 are connected together, and a distal end portion of the other connector housing 68 is held in intimate contact with the waterproof packing 71, and a lock arm 72 on the hood portion 66 is engaged with an engagement projection on the other connector housing 68, so that the two connectors are locked to each other. Simultaneously with these actions, a relative shaking movement between the hood portion 66 of the one connector housing and the other connector housing 68 in the direction perpendicular to the connector fitting direction is prevented by the prevention portions 67, and therefore wear of electrical contact portions of the female and male terminals 62 and 70 due to vibrations developing, for example, during the travel of a vehicle is reduced.

In the above related connector, however, although the shaking movement in the direction perpendicular to the connector fitting direction is prevented, a shaking movement in the connector fitting direction is not prevented, and therefore there has been encountered a problem that wear, etc., of the female and male terminals 62 and 70 due to vibrations during the travel of the vehicle and also to vibrations of a nearby equipment, an engine and so on is not completely overcome. And besides, although the relative movement between the hood portion 66 of the one connector housing and the other connector housing 68 is prevented, a relative movement between the inner housing 64 (which is an important portion serving as a terminal receiving portion) of the one connector housing and the other connector housing 68 is not directly prevented, and therefore each mating pair of female and male terminals 62 and 70 are liable to shake relative to each other, which has led to a fear that wear of the two terminals 62 and 70 is not completely overcome. Furthermore, when the connector is used for a long period of time, there is a fear that the shaking prevention portions 67 are subjected to wear and compression deformation by vibrations developing, example, during the travel of the vehicle, so that a relative shaking movement between the two connector housings in the direction perpendicular to the connector fitting direction develops.

It may be proposed to interpose a ring-like shaking prevention member between the two connector housings so as to prevent at least one of the shaking movements developing respectively in the connector fitting direction and in the direction perpendicular to the connector fitting direction. However, when there is used such a separate member (that is, the shaking prevention member), there have been encountered problems that a relative shaking movement between the two connector housings is not directly prevented, which results in an inadequate vibration-resistant performance, that the vibration-resistant performance is not stable due to a variation in dimensional accuracy of the shaking prevention member, and that a connector-fitting load is increased by a sliding resistance developing between the shaking prevention member and the two connector housings.

SUMMARY OF THE INVENTION

This invention has been made in view of the above circumstances, and an object of the invention is to provide a connector having a structure capable of positively preventing a relative shaking movement between fitted male and female connector housings both in a connector fitting direction and in a direction perpendicular to the connector fitting direction, thereby positively preventing wear, etc., of electrical contact portions of male and female terminals.

The above object has been achieved by a connector of the present invention having features recited in the following Paragraphs (1) to (13).

(1) A connector, comprising:
- a connector housing that has a first terminal; and
- an inner housing that has a second terminal, and is configured to be fitted into the connector housing so that the second terminal is connected to the first terminal; and
- wherein a first slanting face is formed on an outer peripheral face of the inner housing;
- wherein the connector housing have a chamber for receiving the inner housing therein when the inner housing is fitted into the connector housing;
- wherein a first prevention face is formed on an inner peripheral face of the chamber; and
- wherein the first slanting face is surface-contacted with the first prevention face when the inner housing is completely fitted into the connector housing.

(2) The connector as set forth in (1), further comprising:
- an outer housing that holds the inner housing so that the inner housing is movable in a fitting direction of the inner housing and the connector housing; and
- a first resilient member that is provided between the inner housing and the outer housing, and urges the inner housing in the fitting direction by a resilient force of the first resilient member so that the first slanting face is pressed against the first prevention face when the inner housing is completely fitted into the connector housing.

(3) The connector as set forth in (1), wherein a second slanting face is formed on the outer peripheral face of the inner housing so that the second slanting face and the first slanting face are arranged in a fitting direction of the inner housing and the connector housing;

wherein a second prevention face is formed on the inner peripheral face of the chamber so that the second prevention face and the first prevention face are arranged in the fitting direction; and wherein when the inner housing is completely fitted into the connector housing, the first slanting face is surface-contacted with the first prevention face, while the second slanting face is surface-contacted with the second prevention face.

(4) The connector as set forth in (3), wherein the surface contact between the first slanting face and the first prevention face and the surface contact between the second slanting face and the second prevention face are performed simultaneously at the time when the inner housing is completely fitted into the connector housing.

(5) The connector as set forth in (3), further comprising an outer housing that holds the inner housing so that the inner housing is movable in the fitting direction; and a first resilient member that is provided between the inner housing and the outer housing, and urges the inner housing in the fitting direction by a resilient force of the first resilient member so that the first slanting face is pressed against the first prevention face and the second slanting face is pressed against the second prevention face when the inner housing is completely fitted into the connector housing.

(6) The connector as set forth in (3), wherein a slanting degree of the second slanting face is greater than that of the first slanting face.

(7) The connector as set forth in (3), wherein the inner housing includes an annular shaking prevention member which is provided on a peripheral wall of the inner housing so as to slidable on the inner housing in the fitting direction;

wherein the shaking prevention member has the first slanting face on an outer peripheral face thereof; and wherein a second resilient member is provided on the inner housing, and urges the shaking prevention member in the fitting direction by a resilient force of the second resilient member so as to press the first slanting face against the first prevention face when the inner housing is completely fitted into the connector housing.

(8) The connector as set forth in (1), further comprising a connector assisting mechanism that assists a fitting operation of the inner housing and the connector housing, and maintains the inner housing and the connector housing in the completely-fitted condition.

(9) The connector as set forth in (8), wherein the assisting mechanism includes:

a pair of engagement lock projections that are formed respectively on opposite side portions of an outer peripheral face of the connector housing, and are spaced from each other in a direction perpendicular to the fitting direction;

a pair of pivot shafts that are formed respectively on opposite side portions of an outer peripheral face of the outer housing, and are spaced from each other in the direction perpendicular to the fitting direction; and a pivotal lock lever that is provided on the pivot shafts so as to be pivotally moved about the pivot shafts;

wherein the pivotal lock lever has a pair of lock grooves having an arcuate shape for respectively receiving the engagement lock projections so as to guide the engagement lock projections; and wherein when the pivotal lock lever is pivotally moved, the engagement lock projections are guided by the respective lock grooves so that the inner housing and the connector housing are fitted together or are disengaged from each other.

(10) The connector as set forth in (2), further comprising a forward withdrawal prevention mechanism that is provided between the inner housing and the outer housing, wherein the forward withdrawal prevention mechanism prevents the inner housing from being withdrawn forwardly from the outer housing in the fitting direction by the first resilient member.

(11) The connector as set forth in (1), wherein the first slanting face has a plurality of slanting face portions which are divided by a plurality of slits; and wherein the slits extend in the fitting direction, and are spaced from one anther in a peripheral direction of the outer peripheral face of the inner housing.

(12) The connector as set forth in (3), wherein at least one of the first slanting face and the second slanting face has a plurality of slanting face portions which are divided by a plurality of slits; and wherein the slits extend in the fitting direction, and are spaced from one anther in a peripheral direction of the outer peripheral face of the inner housing.

(13) The connector as set forth in (7), wherein the first slanting face has a plurality of slanting face portions which are divided by a plurality of slits; and wherein the slits extend in the fitting direction, and are spaced from one anther in a peripheral direction of the outer peripheral face of the inner housing.

In the connector, when the inner housing (male connector housing) and the connector housing are completely fitted together, the plurality of slanting portions (that is, the first and second prevention faces) which are arranged in the fitting direction are held in surface-to-surface contact respectively with the plurality of slanting portions (that is, the first and second slanting faces) which are arranged in the fitting direction. Therefore, the shaking (the relative shaking movement) not only in the direction perpendicular to the connector fitting direction but also in the connector fitting direction is prevented. Therefore, wear, etc., of the electrical contact portions of the first and second terminals are prevented. For example, even when a wire, electrically connected to the second terminal held in the inner housing, is shaken by vibrations, the connector is less liable to be affected by the shaking of the wire as compared with a connector in which only the first prevention face and the first slanting face are formed, while omitting the formation of the second prevention face and the second slanting face, or only the second prevention face and the second slanting face are formed, while omitting the formation of the first prevention face and the first slanting face.

In the connector of the construction, the surface-to-surface contact between the first prevention face and the first slanting face and the surface-to-surface contact between the second prevention face and the second slanting face are effected simultaneously at the time when the inner housing and the connector housing are completely fitted together, and therefore the effect of preventing the shaking both in the direction perpendicular to the connector fitting direction and in the connector fitting direction is enhanced.

In the connector, when the inner housing and the connector housing are completely fitted together, the first and second prevention faces are held in firm surface-to-surface contact respectively with the first and second slanting faces by the resilient force (that is, the resilient restoring force) of the first resilient member, and therefore the effect of preventing the shaking both in the direction perpendicular to the connector fitting direction and in the connector fitting direction is further enhanced.

In the connector, when the inner housing and the connector housing are completely fitted together, the first prevention face and the first slanting face are held in firm surface-to-surface contact with each other by the first resilient force (that is, the resilient restoring force) of the first resilient member, and independently of this operation, the second prevention face and the second slanting face are also held in firm surface-to-surface contact with each other by the resilient force (that is, the resilient restoring force) of the second resilient member. Therefore, the shaking both in the direction perpendicular to the connector fitting direction and in the connector fitting direction is positively prevented. And besides, in the connector, dimensional tolerances with respect to the distance between the first and second slanting faces and the distance between the first and second prevention faces can be made less close, and therefore the female and male connector housings can be molded easily, and also the cost can be reduced.

In the connector, the forward withdrawal of the inner housing from the outer housing in the fitting direction by the resilient member is prevented by providing the forward withdrawal prevention mechanism.

In the connector, the forward withdrawal of the shaking prevention member from the inner housing in the fitting direction by the first resilient member is prevented by providing the first forward withdrawal prevention mechanism, and the forward withdrawal of the inner housing from the outer housing in the fitting direction by the second resilient member is prevented by providing the second forward withdrawal prevention mechanism.

In the connector, particularly, the connector housing and the inner housing, urged toward the connector housing by the resilient member, can be easily completely fitted together by the connector fitting/disengaging operation-assisting mechanism.

In the connector, the operation for fitting the inner housing and the connector housing together can be easily assisted with the simple construction, and also the inner housing and the connector housing can be maintained in the completely-fitted condition, and therefore this is preferred.

In the connector, the structure of the connector can be simplified.

In the connector, the divided first slanting face is held in surface-to-surface contact with the first prevention face of the connector housing, and/or the divided second slanting face is held in surface-to-surface contact with the second prevention face of the connector housing. For example, in the case where the peripheral wall of the inner housing has the continuous first slanting face (which is not interrupted) and the continuous second slanting face (which is not interrupted), the first and second slanting faces will not be satisfactorily held in intimate contact with the first and second prevention faces, respectively, unless the first and second slanting faces are precisely formed smoothly over the entire periphery of the peripheral wall, and as a result gaps or clearances, spaced from one another in the peripheral direction, are formed, which leads to a high possibility that an inclination or others develops because of these gaps. However, when the divided first slanting face and the divided second slanting face are brought into abutting engagement with the first and second prevention faces, respectively, the divided portions of the peripheral wall of the inner housing, even if there is a dimensional error, are suitably deformed to absorb this dimensional error, thereby achieving the good surface-to-surface contact, and this good surface-to-surface contact enables the inner housing and the connector housing to be firmly connected together.

In the connector, when the inner housing (the male connector housing) and the female connector housing are completely fitted together, the prevention face is held in firm surface-to-surface contact with the slanting face by the resilient force (that is, the resilient restoring force) of the resilient member, and therefore the shaking (shaking movement) both in the direction perpendicular to the connector fitting direction and in the connector fitting direction is prevented. Therefore, wear, etc., of electrical contact portions of the female and male terminals are positively prevented. The connector is provided with the resilient member, for example a coil spring, which is less susceptible to aged deterioration and characteristics deterioration due to heat and others, and tends to have a smaller amount of permanent set in fatigue as compared with a resilient member molded of synthetic resin, an elastomeric resin or the like. Therefore, the connector is excellent in this respect.

In the connector, the forward withdrawal of the inner housing from the outer housing in the fitting direction by the resilient member (having the high resilient force) is prevented by providing the forward withdrawal prevention mechanism.

In the connector, the operation for fitting the inner housing and the female connector housing together can be easily assisted with the simple construction, and also the inner housing and the female connector housing can be maintained in the completely-fitted condition, and therefore this is preferred.

In the present invention, when the male connector housing and the connector housing are completely fitted together, the plurality of slanting portions (that is, the first and second slanting faces) which are arranged in the fitting direction are held in surface-to-surface contact respectively with the plurality of slanting portions (that is, the first and second prevention faces) which are arranged in the fitting direction. Therefore, the shaking (the relative shaking movement) both in the direction perpendicular to the connector fitting direction and in the connector fitting direction upon application of vibrations is prevented. Therefore, wear of the electrical contact portions of the male and female terminals (provided within the two connector housings) is positively prevented, so that the reliability of the electrical connection is enhanced.

In the present invention, when the male connector housing and the female connector housing are completely fitted together, the slanting surface of the shaking prevention portion is held in firm surface-to-surface contact with the prevention surface by the resilient force (that is, the resilient restoring force) of the resilient member. Therefore, the shaking (shaking movement) both in the direction perpendicular to the connector fitting direction and in the connector fitting direction upon application of vibrations is prevented. Therefore, wear of the electrical contact portions of the male and female terminals (provided within the two connector housings) is positively prevented, so that the reliability of the electrical connection is enhanced.

In the invention, the division sections of the slanting surface of the divided shaking prevention portion are held in surface-to-surface contact with the prevention surface of the female connector housing, and therefore the shaking prevention effect is enhanced, and the two connector housings are firmly connected together.

The present invention has been briefly described above. Details of the invention will become manifest upon reading the following Section "Best Mode for Carrying Out the Invention" with reference to the accompanying drawings.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will now be described in detail with reference to the drawings.

Figure 1:
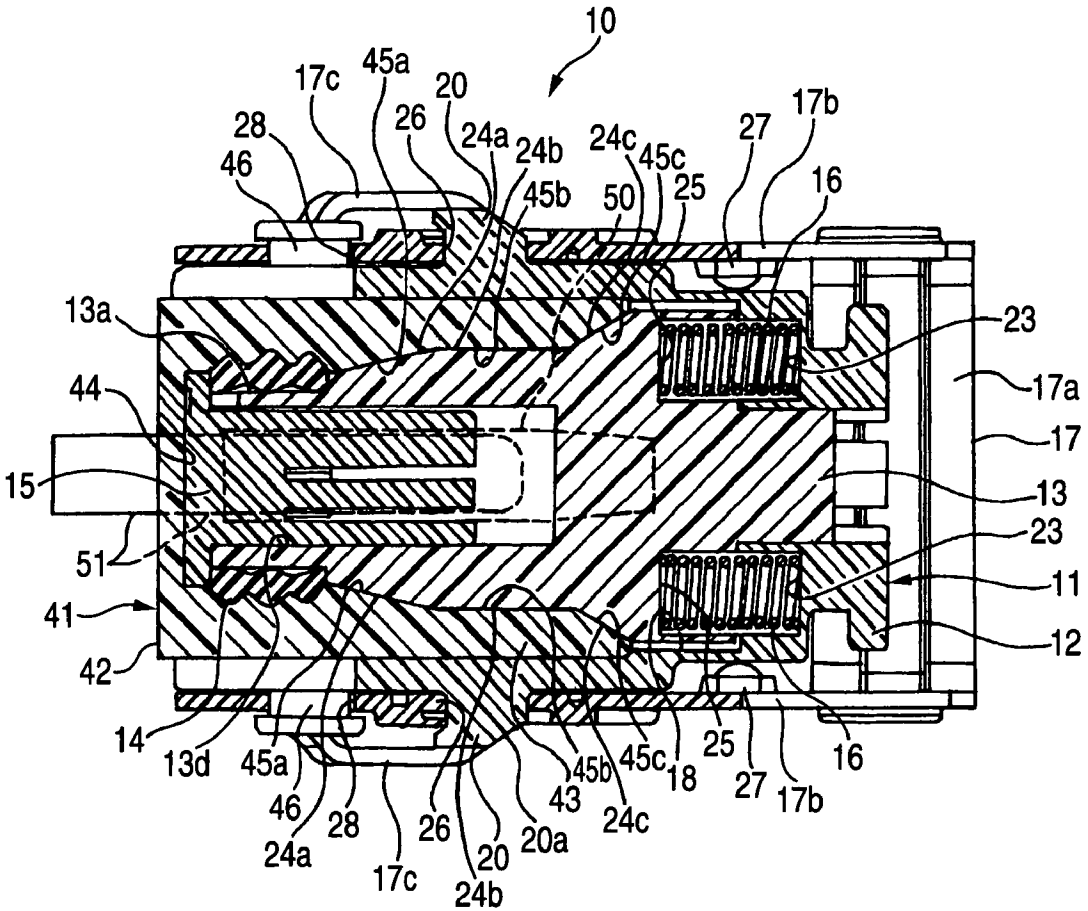
FIG. 1 is a horizontal cross-sectional view of a connector according to a first embodiment of the present invention (i.e., a connector having male and female connectors fitted together)
Figure 2:
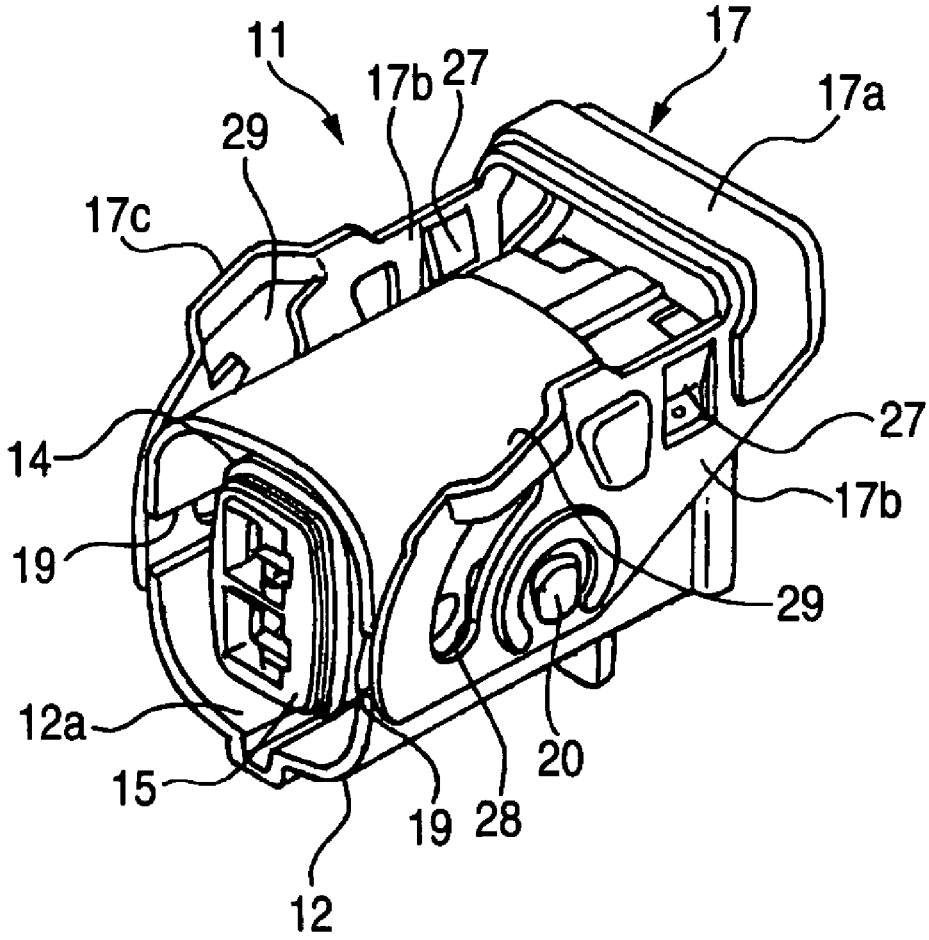
FIG. 2 is a perspective view of the male connector of FIG. 1, showing its appearance (A pivotal lock lever is held in a position where the connector is in a completely-fitted condition)
Figures 3A, 3B:
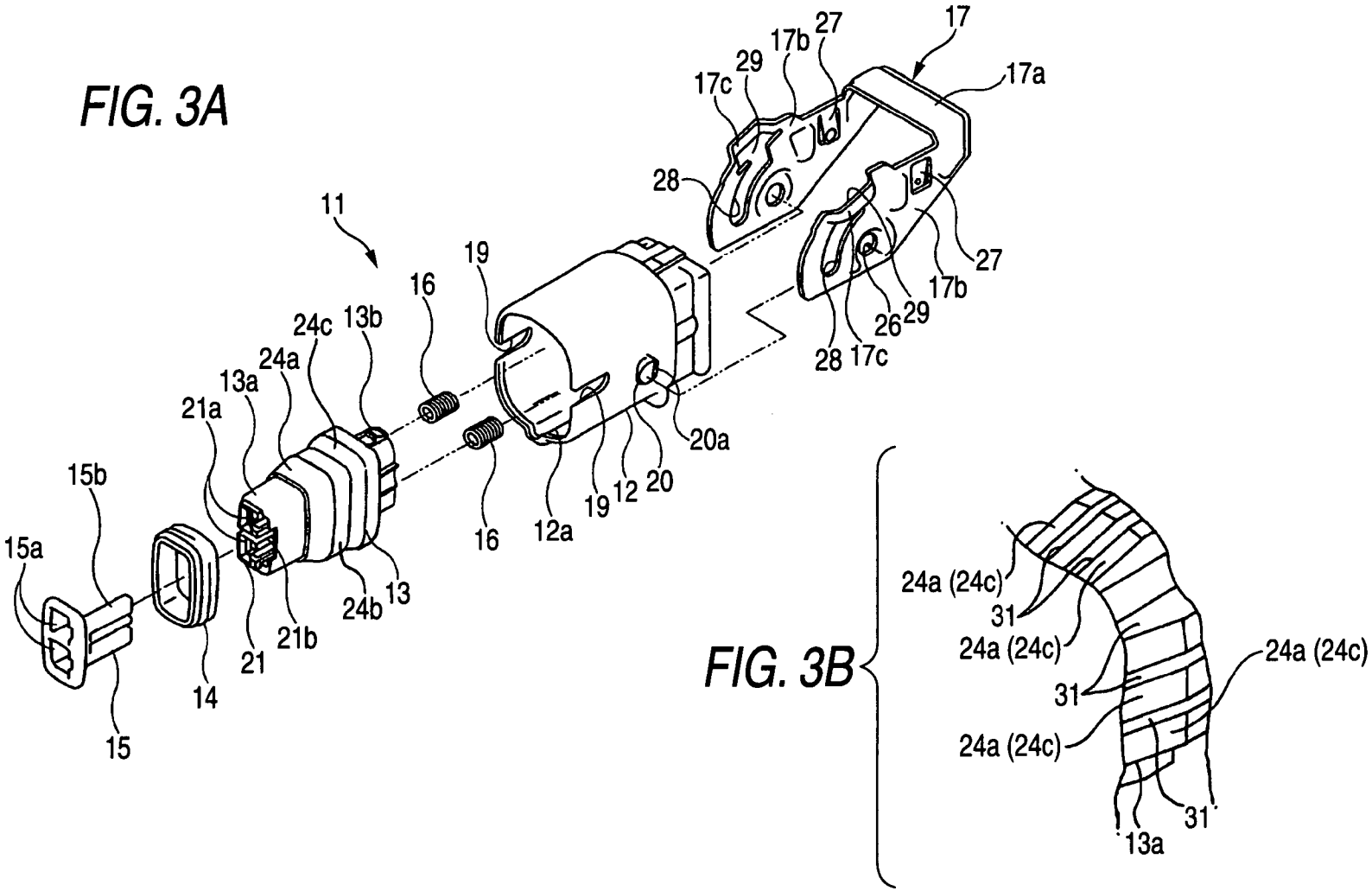
FIG. 3A is an exploded, perspective view of the male connector of FIG. 2.
FIG. 3B is a fragmentary perspective view of an important portion of a modified example regarding a first shaking prevention slanting surface and a second shaking prevention slanting surface.
Figure 4:
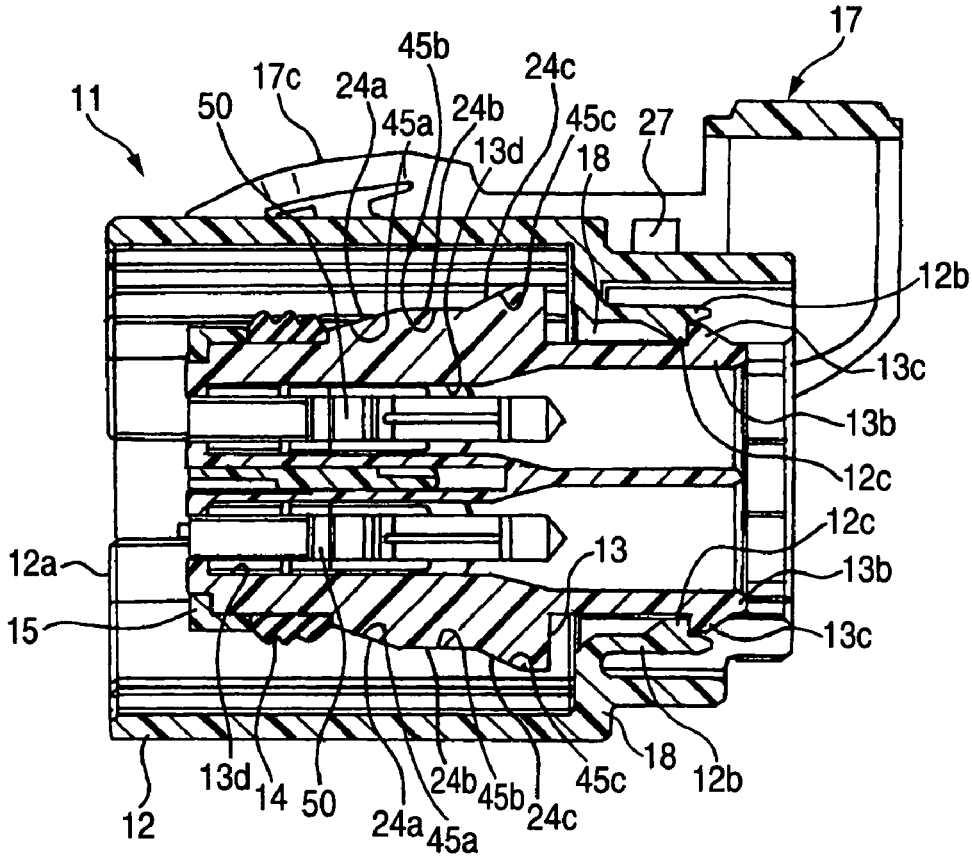
FIG. 4 is a vertical cross-sectional view of the male connector of FIG. 2.

FIG. 1 is a horizontal cross-sectional view of a connector according to a first embodiment of the present invention (i.e., the connector 10 having male and female connectors 11 and 41 fitted together), FIG. 2 is a perspective view of the male connector 11 of FIG. 1, showing its appearance (A pivotal lock lever 17 is held in a position where the connector 10 is in a completely-fitted condition), FIG. 3A is an exploded, perspective view of the male connector 11 of FIG. 2, FIG. 3B is a fragmentary perspective view of an important portion of a modified example in which a plurality of slits 31, extending in a connector fitting direction, are formed in a peripheral wall 13*a* of an inner housing 13, and are spaced from one anther in a peripheral direction to divide at least one of a first shaking prevention slanting surface 24*a* and a second shaking prevention slanting surface 24*c* into a plurality of sections, and FIG. 4 is a vertical cross-sectional view of the male connector 11 of FIG. 2.

As shown in FIGS. 1 to 4, the connector 10 includes the male connector 11, the female connector 41 for fitting to the male connector 11, and the pivotal lock lover 17 pivotally supported by pivot shafts 20 on the male connector 11 so as to be engaged with the female connector 41. The pivotal lock lever 17 is a connector fitting/disengaging operation-assisting member which cooperates with the pivot shafts 20 and engagement lock projections 46 of the female connector 41 to assist the male and female connectors 11 and 41 in their fitting and disengaging operations so that the male and female connectors 11 and 41 can be easily fitted together and disengaged from each other with a small force. This assisting member can be locked to maintain the male and female connectors 11 and 41 in the completely-fitted condition.

The male connector 11 includes a male connector housing, and more specifically includes an outer housing 12, and an inner housing 13 of the male type supported by the outer housing 12 so as to move in the connector fitting direction within the outer housing 12. The inner housing 13 functions as a terminal receiving portion of the male connector 11, and has two terminal receiving chambers 13*d* formed therein, and two female terminals 50 can be received in these terminal receiving chambers 13*d*, respectively. Each female terminal 50 is provisionally retained by an elastic retaining lance (not shown), and is held in the terminal receiving chamber 13*d*. The male connector 11 further includes an annular waterproof packing 14, a front holder 15 for completely retaining the female terminals 50 respectively in the terminal receiving chambers 13*d* of the inner housing 13, a pair of metal coil springs 16 (one example of resilient members), and the above-mentioned pivotal lock lever 17. On the other hand, the female connector 41 includes a female connector housing 42 holding two male terminals 51 (only one of which is shown) (More specifically, the two male terminals 51 are molded integrally in the female connector housing 42).

Here, for description purposes, the front and rear sides, the upper and lower sides and the left and right sides are defined as follows. The forward-rearward direction is defined as the connector fitting direction, and fitting ends of the male and female connectors 11 and 41 are "the front side", while the opposite ends thereof are "the rear side". The upward-downward direction is defined as the direction of arrangement of the two female terminals 50 and hence the direction of arrangement of the male terminals 51 to which the female terminals can be electrically connected, and "the upper side" is that side (for example, the rear side in FIG. 1, the upper side in FIG. 2 and the upper side in FIG. 4) where an operating portion 17*a* of the pivotal lock lever 17 is disposed, while the opposite side is "the lower side". The left-right direction is the direction of arrangement of the pivot shafts 20 and hence the direction of arrangement of the engagement lock projections 46.

Each of the outer housing 12 and the inner housing 13 is formed by injection molding of a synthetic resin material. The outer housing 12 is formed into a generally oval tubular (or hollow cylindrical) shape, and has an open front side 12*a*. The inner housing 13 is provided within a hollow portion of the outer housing 12 so as to move in the connector fitting direction. As shown in FIGS. 3A and 4, the inner housing 13 has a pair of engagement projection portions 13*b* formed on and extending rearwardly respectively from upper and lower portions of a rear portion of its peripheral wall 13*a* of a generally oval tubular shape in a cantilever-like manner. The upper and lower engagement projection portions 13*b* have respective engagement projections 13*c* projecting upwardly and downwardly respectively from their plate-like bodies. On the other hand, the outer housing 12 has a pair of retaining projection portions 12*b* formed on and extending rearwardly respectively from upper and lower portions of an inner peripheral surface of a housing mounting portion 18 (formed at a rear portion of the outer housing 12) in a cantilever-like manner. The upper and lower retaining projection portions 12*b* have respective retaining projections 12*c* projecting downwardly and upwardly respectively from their plate-like bodies.

The engagement projection portions 13*b* of the inner housing 13 are retained respectively by the retaining projection portions 12*b* within the outer housing 12. More specifically, a front surface of each engagement projection 13*c* engages (abuts against) a rear surface of the corresponding retaining projection 12*c* so as to prevent the forward movement of the inner housing 13 relative to the outer housing 12. Thus, the male connector 11 is provided with a forward-withdrawal prevention mechanism (including the engagement projection portions 13*b* and the retaining projection portions 12*b*) for preventing the inner housing 13 from being withdrawn forwardly from the outer housing 13 in the connector fitting direction.

The outer housing 12 has an outer peripheral wall extending forwardly from the housing mounting portion 18 in surrounding relation to the inner housing 13, and this outer peripheral wall functions as a hood for guiding a peripheral wall 43 of the female connector housing 42 of the female connector 41 which is fitted into an annular space formed between the outer housing 12 and the inner housing 13.

As shown in FIG. 3A, slit-like lock projection-receiving portions 19 are formed respectively in opposed left and right portions of the outer peripheral wall of the outer housing 12, and extend in the connector fitting direction. The pivot shafts 20 are formed integrally on the outer surface of the outer peripheral wall of the outer housing 12, and are disposed respectively on lines of extension of the lock projection receiving portions 19. Each pivot shaft 20 has a slanting surface 20*a* slanting inwardly toward the rear side of the outer housing 12. Spring receiving holes 23 for respectively receiving rear end portions of the pair of coil springs 16 are formed respectively in left and right portions of an inner surface of a rear wall of the housing mounting portion 18 of the outer housing 12.

Receiving chamber ports 21*a* are formed in a front side (front surface) 21 of the inner housing 13, and are aligned respectively with male terminal insertion holes 15*a* in the front holder 15. Also, an insertion hole 21*b* is formed in this front side 21, and an insertion portion 15*b* of the front holder 15 is inserted into this insertion hole 21*b*, and is retained therein. The receiving chamber ports 21*a* in the inner housing 13 communicate with the terminal receiving chambers 13*d*, respectively. When the male connector 11 and the female connector 41 are fitted together, an electrical contact portion of each of the male terminals 51 of the female connector 41 is guided into the corresponding terminal receiving chamber 13*d* through the corresponding male terminal insertion hole 15*a* of the front holder 15 and the corresponding receiving chamber port 21*a* of the inner housing 12, and is brought into contact with an electrical contact portion of the corresponding female terminal 50 in the terminal receiving chamber 13*d*, and therefore is electrically connected thereto.

The outer peripheral surface of the peripheral wall 13*a* of the inner housing 13 has a surface on which the waterproof packing 14 is mounted, the first shaking prevention slanting surface 24*a* which is continuous with this mounting surface, an intermediate outer peripheral surface 24*b* which is continuous with the first shaking prevention slanting surface 24*a*, and the second shaking prevention slanting surface 24*c* which is continuous with the intermediate outer peripheral surface 24*b*. The surface, the first shaking prevention slanting surface 24*a*, the intermediate outer peripheral surface 24*b*, and the second shaking prevention slanting surface 24*c* are arranged in this order from the front side 21 of the inner housing 13 toward the rear portion thereof having the engagement projection portions 13*b* formed thereon. Each of these surfaces is formed continuously over the entire periphery of the peripheral wall 13*a* without interruption. Thus, the first shaking prevention slanting surface 24*a* and the second shaking prevention slanting surface 24*c* are arranged in spaced relation to each other in the connector fitting direction. Each of the first and second shaking prevention slanting surfaces 24*a* and 24*c* has an outer shape generally resembling a quadrangular pyramid-shape with rounded four corners.

More specifically, the first shaking prevention slanting surface 24*a* slants (or tapers) in a manner to approach the axis of the inner housing 13 gradually from the rear side thereof toward the front side thereof. Also, the second shaking prevention slanting surface 24*c* slants (or tapers) in a manner to approach the axis of the inner housing 13 gradually from the rear side thereof toward the front side thereof, but a slanting angle of the second shaking prevention slanting surface 24*c* is larger than that of the first shaking prevention slanting surface 24*a*. The intermediate outer peripheral surface 24*b*, formed between the first and second shaking prevention slanting surfaces 24*a* and 24*c*, is substantially not slanted.

When the male connector 11 and the female connector 41 are completely fitted together, the first shaking prevention slanting surface 24*a* is held in surface-to-surface contact with a first prevention surface 45*a* formed on an inner peripheral surface of the peripheral wall 43 of the female connector housing 42, as shown in FIG. 1. When the male connector 11 and the female connector 41 are completely fitted together, the second shaking prevention slanting surface 24*c* is held in surface-to-surface contact with a second prevention surface 45*c* formed on the inner peripheral surface of the peripheral wall 43 of the female connector housing 42, as shown in FIG. 1. When the male connector 11 and the female connector 41 are completely fitted together, the intermediate outer peripheral surface 24*b* is opposed to an intermediate inner peripheral surface 45*b* formed on the inner peripheral surface of the peripheral wall 43 of the female connector housing 42, and preferably is held in close surface-to-surface contact with the intermediate inner peripheral surface 45*b* over the entire periphery thereof, as shown in FIG. 1.

As shown in FIG. 3B, the plurality of slits 31, which extend in the connector fitting direction, and are spaced from one anther in the peripheral direction, can be formed in the peripheral wall 13*a* of the inner housing 13 to divide at least one of the first shaking prevention slanting surface 24*a* and the second shaking prevention slanting surface 24*c* into the plurality of sections.

Spring receiving holes 25 for respectively receiving the front end portions of the pair of coil springs 16 are formed in the rear end portion of the peripheral wall 13*a* of the inner housing 13, and are disposed to be opposed respectively to the spring receiving holes 23 in the outer housing 12. The waterproof packing 14 is molded of synthetic rubber, an elastomeric resin or the like, and is formed into a generally oval tubular (or hollow cylindrical) shape. This waterproof packing 14 is mounted on that surface of the peripheral wall 13*a* of the inner housing 13 disposed at the front side of the first shaking prevention slanting surface 24*a*, and is prevented by the front holder 15 from being withdrawn forwardly.

The pivotal lock lever 17 cooperates with the pivot shafts 20 and the engagement lock projections 46 to form a connector fitting/disengaging operation-assisting mechanism, and this pivotal lock lever 17 is made of metal, a synthetic resin or other material. The pivotal lock lever 17 has a generally U-shaped cross-section, and includes the operating portion 17*a*, and side plate portions 17*b* extending generally perpendicularly from opposite (left and right) ends of the operating portion 17*a*, respectively. The pivotal lock lever 17 is mounted on the outer housing 12 in such a manner that the outer housing 12 is disposed between the two side plate portions 17*b*. Each of the side plate portions 17*b* includes a mounting hole 26 in which the corresponding pivot shaft 20 of the outer housing 12 is rotatably engaged, a spring plate portion 27 resiliently held against the side surface of the outer housing 12, and a lock groove 28 of an arcuate shape. Each of the lock grooves 28 is open at its one longitudinal end so that the engagement lock projections 46, formed respectively on the left and right side surfaces of the peripheral wall 43 of the female connector housing 41, can be easily introduced into the lock grooves 28, respectively. More specifically, in order that the engagement lock projection 46 can be easily introduced into the lock groove 28, part 17*c* of each side plate portion 17*b* is bulged outwardly to form a lock projection-introducing port 29 which communicates with the open end of the lock groove 28.

The female connector housing 42 of the female connector 41 has a connector fitting chamber 44 (of a tubular shape with a closed bottom) formed by the inner peripheral surface of the peripheral wall 43, the connector fitting chamber 44 being open at its front side. The inner peripheral surface of the connector fitting chamber 44, formed by the peripheral wall 43, has a surface for surrounding the outer peripheral surface of the front holder 15, a surface (continuous with this surrounding surface) for intimate contact with the outer peripheral surface of the waterproof packing 14, the first prevention surface 45*a* of a tapering shape (continuous with this contact surface), an intermediate inner peripheral surface 45*b* (continuous with the first prevention surface 45*a*) and the second prevention surface 45*c* (continuous with the intermediate inner peripheral surface 45*b*) which are arranged in this order from an inner end wall of the connector fitting chamber 44 (from which the male terminals project) toward the open front side thereof. Thus, the first prevention surface 45*a* and the second prevention surface 45*b* are arranged in spaced relation to each other in the connector fitting direction.

More specifically, the first prevention surface 45*a* is slanting (or tapering) in a manner to approach the axis of the female connector housing 42 gradually from the front side thereof toward the rear side thereof. When the male connector 11 and the female connectors 41 are fitted together, the first prevention surface 45*a* abuts against the first shaking prevention slanting surface 24*a* of the male connector 11, and this first prevention surface 45*a* is formed on the peripheral wall 43 of the connector fitting chamber 44 at the same slanting angle as that of the first shaking prevention slanting surface 24*a*. The second prevention surface 45*c* is slanting (or tapering) in a manner to approach the axis of the female connector housing 42 gradually from the front side thereof toward the rear side thereof. When the male connector 11 and the female connectors 41 are fitted together, the second prevention surface 45*c* abuts against the second shaking prevention slanting surface 24*c* of the male connector 11, and this second prevention surface 45*c* is formed on the peripheral wall 43 of the connector fitting chamber 44 at the same slanting angle as that of the second shaking prevention slanting surface 24*c*. The intermediate inner peripheral surface 45*b*, formed between the first and second prevention surfaces 45*a* and 45*c*, is substantially not slanting.

Next, a method of assembling the male connector 11 will be described. With respect to the female connector 41, the female connector housing 42 can be formed (molded), with the male terminals 51 insert-molded therein, and therefore detailed description of its assembling method is omitted. However, there can be used a construction in which suitable terminal receiving chambers are formed within the female connector housing 42, and the male terminals 51 are retained by suitable retaining member (such as elastic retaining lances) within the respective terminal receiving chambers.

The male connector 11 is assembled as follows. The waterproof packing 14 is mounted on the front portion of the peripheral wall 13*a* of the inner housing 13 having the female terminals 50 received respectively within the terminal receiving chambers 13*d*. Then, the insertion portion 15*b* of the front holder 15 is inserted into the insertion hole 21*b* in the inner housing 13, so that the front holder 15 is engaged in the interior of the inner housing 13, and is mounted therein. As a result of mounting the front holder 15 in the inner housing 13, the female terminals 50 are retained in a double manner within the respective terminal receiving chambers 13*d*, and also the waterproof packing 14 is prevented from being withdrawn forwardly from the inner housing 13.

Then, the front end portions of the coil springs 16 are inserted respectively into the spring receiving holes 25 from the rear side of the inner housing 13, with the rear end portions of the coil springs 16 projecting respectively from the spring receiving holes 25, and in this condition the inner housing 13 is fitted into the housing mounting portion 18 of the outer housing 12 while the rear end portions of the coil springs 16 are inserted respectively into the spring receiving holes 23 in the outer housing 12.

The inner housing 13 is pushed deep into the housing mounting portion 18 toward the inner end thereof against resilient forces (that is, resilient restoring forces) of the coil springs 16, and when the engagement projection portions 13*b* of the inner housing 13 are brought into engagement with the retaining projection portions 12*b* of the outer housing 12, respectively, the coil springs 16 are held between the inner housing 13 and the outer housing 12. In this manner, the inner housing 13 and the outer housing 12 are combined or assembled together. In this completely-assembled condition of the inner and outer housings 13 and 12, the coil springs 16 may or may not be compressed between the inner and outer housings 13 and 12.

Then, the pivotal lock lever 17 is brought close to the rear side of the outer housing 12, and as the outer housing 13 is inserted between the pair of side plate portions 17*b* of the pivotal lock lever 17 to be disposed therebetween, end edges of the side plate portions 17*b* are brought into abutting engagement with the slanting surfaces 20*a* of the pivot shafts 20, respectively, and then the side plate portions 17*b* are temporarily deformed outwardly away from each other, and when the mounting holes 26 are brought into alignment with the left and right pivot shafts 20, respectively, the pivot shafts 20 become engaged in the mounting holes 26, respectively. In this manner, the pivotal lock lever 17 is mounted on the outer housing 12, thus completing the assembling of the male connector 11.

In this manner, the pivotal lock lever 17 is mounted on the outer housing 12 so as to be pivotally moved about the pivot shafts 20 in the forward and rearward directions, and particularly the pivotal lock lever 17 can be switched (or moved) between an unlocked position (shown in FIG. 5A) where the pivotal lock lever 17 is held in an upstanding condition, with the operating portion 17*a* disposed generally perpendicular to the upper surface of the outer housing 12 and a locked position (shown in FIGS. 1, 2, 4 and 5B) where the pivotal lock lever 17 is laid flat rearwardly, with the operating portion 17*a* disposed generally horizontally in generally parallel relation to the upper surface of the outer housing 12.

Figure 5A:
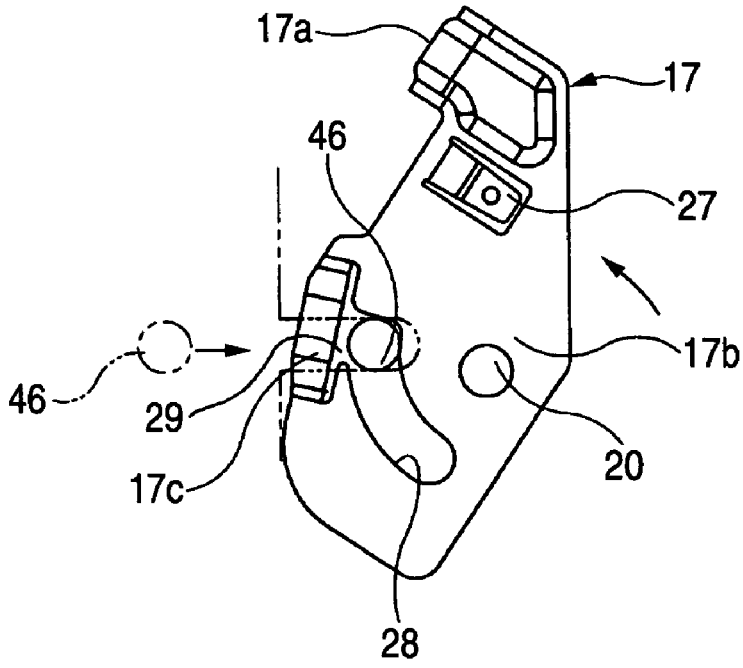
FIGS. 5A and 5B are views explanatory of a locking operation achieved by a connector fitting/disengaging operation-assisting mechanism of the connector of FIG. 1.
Figure 5B:
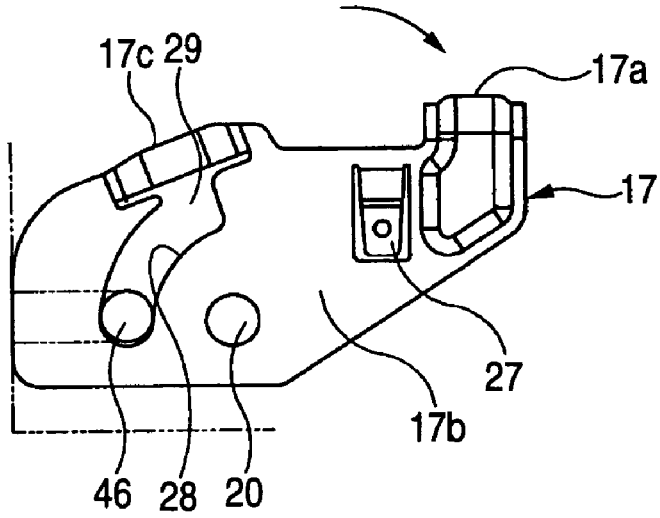

FIGS. 5A and 5B are views explanatory of a locking operation of the connector fitting/disengaging operation-assisting mechanism (including the pivotal lock lever 17, the pivot shafts 20 and the engagement lock projections 46) of the connector of FIG. 1. As is clear from FIG. 5A, when the pivotal lock lever 17 is located in the unlocked position where it is disposed in the upstanding condition, each lock projection-introducing port 29 is open forwardly, that is, toward the female connector housing 42 at the time of starting the operation for fitting the male and female connectors 11 and 41 together.

Next, a method of fitting the connector 10 will be described.

The pivotal lock lever 17 of the male connector 11 is held in the unlocked position as shown in FIG. 5A, and in this condition when the peripheral wall 43 of the female connector housing 42 is fitted into the annular space between the outer housing 12 and the inner housing 13, the inner housing 13 is also fitted into the connector fitting chamber 44 of the female connector housing 42. At this time, each engagement lock projection 46 of the female connector housing 42 enters the corresponding lock projection receiving portion 19 of the outer housing 12, and then passes through the lock projection-introducing port 29, and is disposed in the open end of the lock groove 28. FIG. 5A shows this condition in which the male connector 11 and the female connector 41 are in a half-fitted condition.

Then, when the operating portion 17*a* is pushed rearwardly to pivotally move the pivotal lock lever 17 about the pivot shafts 20 rearwardly from the unlocked position (FIG. 5A) toward the locked position, each engagement lock projection 46, while guided by the corresponding lock groove 28, moves along this lock groove 28 from the one end thereof toward the other end thereof, so that the operation for fitting the male and female connectors 11 and 41 together proceeds. At this time, simultaneously when the first prevention surface 45*a*, disposed close to the inner end of the connector fitting chamber 44, abuts against the first shaking prevention slanting surface 24*a* of the inner housing 13, the second prevention surface 45*c*, formed at a peripheral edge portion of the open end portion of the connector fitting chamber 44, abuts against the second shaking prevention slanting surface 24*c* of the inner housing 13. In this condition, when the operating portion 17*a* is further pushed rearwardly to pivotally move the pivotal lock lever 17 into the locked position (FIG. 5B), the male connector 11 and the female connector 41 are completely fitted together, and also, within these connectors, the first and second shaking prevention slanting surfaces 24*a* and 24*c* are pressed respectively by the first and second prevention surface 45*a* and 45*c*, so that the coil springs 16 are compressed.

In this connector completely-fitted condition, the male connector 11 and the female connector 41 are locked against disengagement from each other by the connector fitting/disengaging operation-assisting mechanism including the pivotal lock lever 17 and so on, and this fitted condition is maintained. Therefore, the first and second prevention surfaces 45*a* and 45*c* of the female connector housing 42 are urged by the resilient restoring forces of the coil springs 16 via the first and second shaking prevention slanting surfaces 24*a* and 24*c*, and therefore are held in intimate contact with the first and second shaking prevention slanting surfaces 24*a* and 24*c*, respectively (In other words, the first and second shaking prevention slanting surfaces 24*a* and 24*c* are held in surface-to-surface contact respectively with the first and second prevention surfaces 45*a* and 45*c*, and are kept pressed respectively against the first and second prevention surfaces 45*a* and 45*c* by the resilient restoring forces of the coil springs 16).

In this connector completely-fitted condition, the flat plate-like electrical contact portion of each of the male terminals 51 is inserted in the box-like electrical contact portion of the corresponding female terminal 50 as shown in FIG. 1, so that the electrical contact portions of the female and male terminals 50 and 51 are electrically connected together. In this connector completely-fitted condition, the waterproof packing 14 is held between the inner peripheral surface of the connector fitting chamber 44 of the female connector housing 42 and the outer peripheral surface of the peripheral wall 13*a* of the inner housing 13, and forms a liquid-tight seal between the inner peripheral surface and the outer peripheral surface as shown in FIG. 1. The operation for disengaging the male connector 11 and the female connector 41 from each other is effected by pivotally moving the pivotal lock lever 17 in a direction opposite to the above-mentioned direction.

The present invention is not limited to the above embodiment, and suitable modifications, improvements and so on can be made. And, the material, shape, dimensions, numerical value, form, number, disposition, etc., of each of the constituent elements of the above embodiment are arbitrary, and are not limited in so far as the invention can be achieved.

Figure 6:
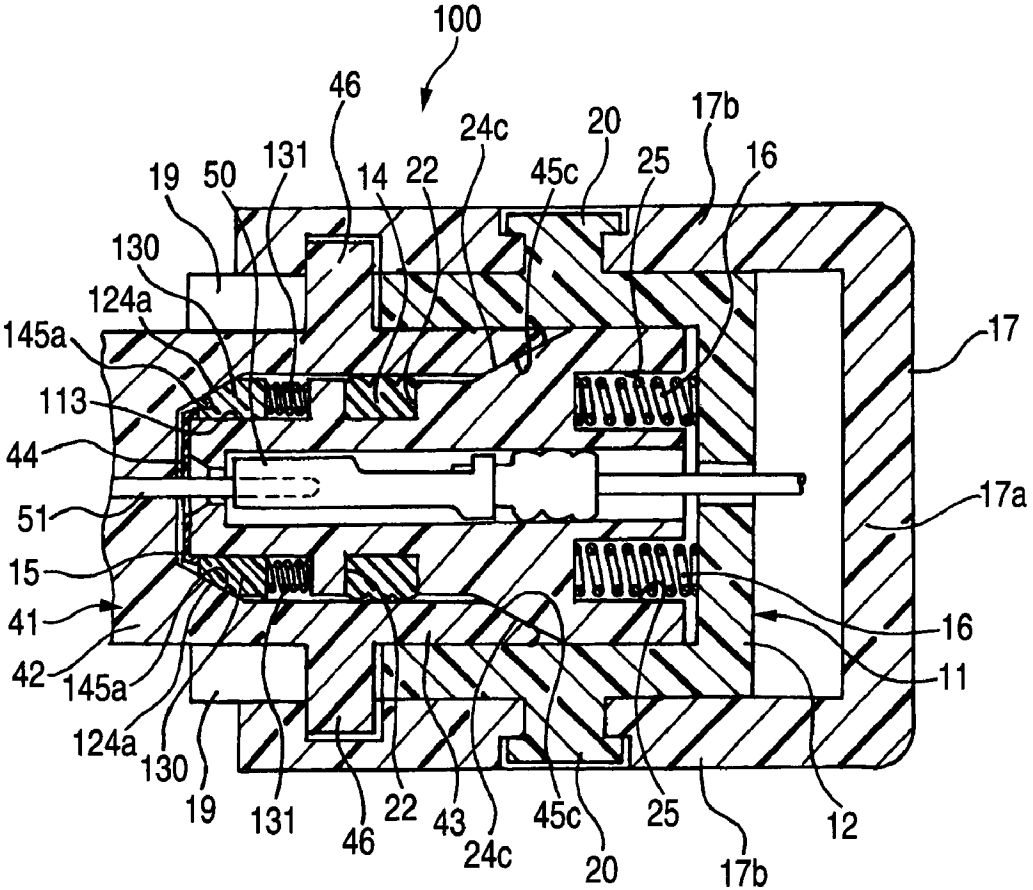
FIG. 6 is a horizontal cross-sectional view roughly showing a modified connector of the first embodiment of the invention.

For example, the above connector 10 can be modified into a connector 100 shown in FIG. 6. In FIG. 6, those constituent elements which are similar in function to the corresponding constituent elements of the already-described connector 10 will be designated by identical or like reference numerals, respectively, and explanation thereof will be briefly made or omitted. As shown in FIG. 6, an inner housing 113 of the connector 100 includes an annular shaking prevention member 130 which is mounted on a peripheral wall of the inner housing 113 so as to slide thereon in a connector fitting direction. An outer peripheral surface of this shaking prevention member 130 forms part of an outer peripheral surface of the inner housing 113, and has a first shaking prevention slanting surface 124*a*. The inner housing 113 of the connector 100 has an annular groove 22 formed in the peripheral wall thereof, and a waterproof packing 14 is mounted in this annular groove 22. The peripheral wall has an annular portion disposed between the waterproof packing 14 and the shaking prevention member 130, the annular portion forming part of the annular groove 22. A pair of coil springs 131 (serving as first resilient members) are held between this annular portion and the shaking prevention member 130 (In this modified example, coil springs 16 serve as second resilient members). When the inner housing 113 and a female connector housing 42 are completely fitted together, the coil springs 131 urge the shaking prevention member 130 in a direction of fitting of the inner housing 113 into the female connector housing 42 by their resilient forces so as to press the first shaking prevention slanting surface 124*a* against a first prevention surface 145*a*. Unlike the front holder of the connector 10, a front holder 15 of this modified example does not need to have the function of preventing forward withdrawal of the waterproof packing 14, but cooperates with the interior of the inner housing 113 (in which this front holder 15 is engaged) to function as a first front withdrawal prevention mechanism for preventing the shaking prevention member 130 from being withdrawn forwardly from the inner housing 113 in the fitting direction by the coil springs 131 (Although the showing of engagement projection portions 13*b* and retaining projection portions 12*b* is omitted in FIG. 6, these portions 13*b* and 12*b* serve as a second forward withdrawal prevention mechanism in this modified example).

In the connector 100 of FIG. 6, when the inner housing 113 and the female connector housing 42 are completely fitted together, the first prevention surface 145*a* and the first shaking prevention slanting surface 124*a* are held in firm surface-to-surface contact with each other by the resilient forces (that is, resilient restoring forces) of the coil springs 131, and independently of this operation, a second prevention surface 45*c* and a second shaking prevention slanting surface 24*c* are also held in firm surface-to-surface contact with each other by the resilient forces (that is, resilient restoring forces) of the coil springs 16. Therefore, a shaking movement both in a direction perpendicular to the connector fitting direction and in the connector fitting direction is positively prevented. And besides, in the connector 100 of FIG. 6, dimensional tolerances with respect to the distance between the first and second shaking prevention slanting surfaces 124*a* and 24*c* and the distance between the first and second prevention surfaces 145*a* and 45*c* can be made less close, and therefore the female and male connector housings can be molded easily, and also the cost can be reduced.

Next, a method of fitting the connector 100 will be described briefly. The connector 100 is assembled in a half-fitted condition, and then when an operating portion 17*a* is pushed rearwardly to pivotally move a pivotal lock lever 17 about pivot shafts 20 rearwardly from an unlocked position (see FIG. 5A) toward a locked position (see FIG. 5B), the first prevention surface 145*a*, disposed close to an inner end of a connector fitting chamber 44, abuts against the first shaking prevention slanting surface 124*a* of the shaking prevention member 130 of the inner housing 113, and thereafter the second prevention surface 45*c*, formed at a peripheral edge portion of an open end portion of the connector fitting chamber 44, abuts against the second shaking prevention slanting surface 24*c* of the inner housing 113. In this condition, when the operating portion 17*a* is further pushed rearwardly to pivotally move the pivotal lock lever 17 into the locked position (see FIG. 5B), the connector 100 is assembled in the completely-fitted condition, and within the connector 100, the first shaking prevention slanting surface 124*a* is pressed by the first prevention surface 145*a*, so that the coil springs 131 are compressed, while the second shaking prevention slanting surface 24*c* is pressed by the second prevention surface 45*c*, so that the coil springs 16 are compressed. In this connector completely-fitted condition, the first prevention surface 145*a* is urged by the resilient restoring forces of the coil springs 131 via the first shaking prevention slanting surface 124*a* of the shaking prevention member 130, and therefore is held in intimate contact with the first shaking prevention slanting surface 124*a*, while the second prevention surface 45*c* is urged by the resilient restoring forces of the coil springs 16 via the second shaking prevention slanting surface 24*c*, and therefore is held in intimate contact with the second shaking prevention slanting surface 24*c*. In this connector completely-fitted condition, an electrical contact portion of each of male terminals 51 is inserted in a box-like electrical contact portion of a corresponding female terminal 50 as shown in FIG. 6, so that the electrical contact portions of the female and male terminals 50 and 51 are electrically connected together. In this connector completely-fitted condition, the waterproof packing 14 is held between an inner peripheral surface 45*b* of the connector fitting chamber 44 of the female connector housing 42 and an intermediate outer peripheral surface 24*b* of the inner housing 113 (see FIG. 1), and forms a liquid-tight seal between the intermediate inner peripheral surface 45*b* and the intermediate outer peripheral surface 24*b*.

Other operations and advantageous effects of the connector 100 of FIG. 6 will be readily appreciated from the above description of the connector 10, and therefore explanation thereof will be omitted.

In the above embodiment and the modified example thereof, although the coil springs (i.e., the coil springs 16 and the coil springs 131) are used as the resilient members, the invention is not limited to the use of such coil springs. Instead of the coil springs, resilient members, molded of a material such for example as synthetic rubber or an elastomeric resin, can be used. And, any other suitable resilient members can be used in so far as they perform generally the same function as the above-mentioned coil springs do. Incidentally, the coil springs are less susceptible to aged deterioration and characteristics deterioration due to heat and others, and tend to have a smaller amount of permanent set in fatigue as compared with the resilient members molded of synthetic resin, an elastomeric resin or the like, and therefore the use of the coil springs is preferred.

The following is the brief description of the features of the connector according to the first embodiment.

The connector 10 (100) comprises:

the female connector housing 42 holding the male terminals 51;

the male inner housing 13 (113) which holds the female terminals 50 for electrical connection to the respective male terminals 51, and can be fitted in the female connector housing 42 such that the female terminals 50 are connected respectively to the male terminals 51;

the first shaking prevention slanting surface 24*a* (124*a*) formed on the outer peripheral surface of the inner housing 13 (113);

the second shaking prevention slanting surface 24*c* which is formed on the outer peripheral surface of the inner housing 13 (113) in such a manner that the second shaking prevention slanting surface 24*c* and the first shaking prevention slanting surface 24*a* (124*a*) are arranged in the fitting direction;

a connector fitting chamber 44 formed in the female connector housing 42 so as to receive the inner housing 13 (113) therein when the inner housing 13 (113) and the female connector housing 42 are fitted together;

a first prevention surface 45*a* (145*a*) formed on the inner peripheral surface of the connector fitting chamber 44; and the second prevention surface 45*c* which is formed on the inner peripheral surface of the connector fitting chamber 44 in such a manner that the second prevention surface 45*c* and the first prevention surface 45*a* (145*a*) are arranged in the fitting direction; and when the inner housing 13 (113) and the female connector housing 42 are fitted together, the first shaking prevention slanting surface 24*a* (124) is held in surface-to-surface contact with the first prevention surface 45*a* (145*a*), while the second shaking prevention slanting surface 24*c* is held in surface-to-surface contact with the second prevention surface 45*c*.

In the connector 10, the inner housing 13 and the female connector housing 42 are so formed that the surface-to-surface contact between the first shaking prevention slanting surface 24*a* and the first prevention surface 45 and the surface-to-surface contact between the second shaking prevention slanting surface 24*c* and the second prevention surface 45*c* are effected simultaneously at the time when the inner housing 13 and the female connector housing 42 are completely fitted together.

The connector 10 further comprises:

the outer housing 12 holding the inner housing 13 in such a manner that the inner housing 13 can be moved in the direction of fitting of the inner housing 13 and the female connector housing 42; and the coil springs 16 which are provided between the inner housing 13 and the outer housing 12, and urge the inner housing 13 in the direction of fitting of the inner housing 13 into the female connector housing 42 by their resilient forces so that when the inner housing 13 and the female connector housing 42 are completely fitted together, the first shaking prevention slanting surface 24*a* can be pressed against the first prevention surface 45*a*, while the second shaking prevention slanting surface 24*c* can be pressed against the second prevention surface 45*c*.

In the connector 100, the inner housing 113 includes the annular shaking prevention member 130 which is mounted on the peripheral wall of the inner housing 113 so as to slide thereon in the fitting direction, and the outer peripheral surface of the shaking prevention member 130 forms part of the outer peripheral surface of the inner housing 113, and has the first shaking prevention slanting surface 124*a*. The connector 100 further comprises:

the coil springs 131 which are provided on the inner housing 113, and urge the shaking prevention member 130 in the direction of fitting of the inner housing 113 into the female connector housing 42 by their resilient forces so as to press the first shaking prevention slanting surface 124*a* against the first prevention surface 145*a* when the inner housing 113 and the female connector housing 42 are completely fitted together;

the outer housing 12 holding the inner housing 113 in such a manner that the inner housing 113 can be moved in the direction of fitting of the inner housing 113 and the female connector housing 42; and the coil springs 16 which are provided between the inner housing 113 and the outer housing 12, and urge the inner housing 113 in the direction of fitting of the inner housing 113 into the female connector housing 42 by their resilient forces so as to press the second shaking prevention slanting surface 24*c* against the second prevention surface 45*c* when the inner housing 113 and the female connector housing 42 are completely fitted together.

The connector 10 (100) further comprises the forward withdrawal prevention mechanism provided between the inner housing 13 and the outer housing 12, and this forward withdrawal prevention mechanism prevents the inner housing 13 from being withdrawn forwardly from the outer housing in the fitting direction by the coil springs 16.

The connector further comprises:

the first forward withdrawal prevention mechanism provided on the inner housing 113; and the second forward withdrawal prevention mechanism provided between the inner housing 113 and the outer housing 12; and the first forward withdrawal prevention mechanism prevents the shaking prevention member 130 from being withdrawn forwardly from the inner housing 113 in the connector fitting direction by the coil springs 131; and the second forward withdrawal prevention mechanism prevents the inner housing 113 from being withdrawn forwardly from the outer housing 12 in the fitting direction by the coil springs 16.

The connector 10 (100) further comprises the connector fitting/disengaging operation-assisting mechanism which assists the inner housing 13 (113) and the female connector housing 43 in their fitting operation, and can maintain the inner housing 13 (113) and the female connector housing 42 in the completely-fitted condition.

The connector fitting/disengaging operation-assisting mechanism of the connector 10 (100) comprises:

the pair of engagement lock projections 46 which are formed respectively on the opposite side portions of the outer peripheral surface of the female connector housing 42, and are spaced from each other in the direction perpendicular to the fitting direction;

the pair of pivot shafts 20 which are formed respectively on the opposite side portions of the outer peripheral surface of the outer housing 12, and are spaced from each other in the direction perpendicular to the fitting direction; and the pivotal lock lever mounted on the pivot shafts 20 so as to be pivotally moved about the pivot shafts 20; and the pivotal lock lever 17 has the pair of lock grooves 28 of an arcuate shape for respectively receiving the engagement lock projections 46 so as to guide these projections 46, and when the pivotal lock lever 17 is pivotally moved, the engagement lock projections 46 are guided by the respective lock grooves 28, so that the inner housing 13 (113) and the female connector housing 42 are fitted together or are disengaged from each other.

In the connector 10 (100), the first shaking prevention slanting surface 24*a* (124*a*) is disposed at the front side in the direction of fitting of the inner housing 13 (113) in the female connector housing 42, while the second shaking prevention slanting surface 24*c* is disposed at the rear side in the direction of fitting of the inner housing 13 (113) in the female connector housing 42. Also, the first prevention surface 45*a* (145*a*) is disposed at the rear side in the direction of fitting of the female connector housing 42 on the inner housing 13 (113), while the second prevention surface 45*c* is disposed at the front side in the direction of fitting of the female connector housing 42 on the inner housing 13 (113). With this arrangement, the structure of the connector 10 (100) can be made simpler as compared with the case where other positional relations with respect to the first and second shaking prevention slanting surfaces 24*a* (124*a*) and 24*c* and the first and second prevention surfaces 45*a* (145*a*) and 45*c* are adopted.

In the connector 10 (100), the plurality of slits 31, extending in the fitting direction, are formed in the peripheral wall of the inner housing 13 (113), and are spaced from one anther in the peripheral direction to divide at least one of the first shaking prevention slanting surface 24*a* (124*a*) and the second shaking prevention slanting surface 24*c* into the plurality of sections.

As described above, in the connector 10 (100), when the inner housing (male connector housing) 13 (113) and the female connector housing 42 are completely fitted together, the plurality of slanting portions (that is, the first and second prevention surfaces 45*a* (145*a*) and 45*c*) which are arranged in the fitting direction are held in surface-to-surface contact respectively with the plurality of slanting portions (that is, the first and second shaking prevention slanting surfaces 24*a* (124*a*) and 24*c*) which are arranged in the fitting direction. Therefore, the shaking (the relative shaking movement) not only in the direction perpendicular to the connector fitting direction but also in the connector fitting direction is prevented. Therefore, wear, etc., of the electrical contact portions of the male and female terminals 51 and 50 are prevented. For example, even when a wire, electrically connected to the female terminal 50 held in the inner housing 13 (113), is shaken by vibrations, the connector is less liable to be affected by the shaking of the wire as compared with a connector in which only the first prevention surface 45*a* (145*a*) and the first shaking prevention slanting surface 24*a* (124*a*) are formed, while omitting the formation of the second prevention surface 45*c* and the second shaking prevention slanting surface 24*c*, or only the second prevention surface 45*c* and the second shaking prevention slanting surface 24*c* are formed, while omitting the formation of the first prevention surface 45*a* (145*a*) and the first shaking prevention slanting surface 24*a* (124*a*).

In the connector 10, the surface-to-surface contact between the first prevention surface 45*a* and the first shaking prevention slanting surface 24*a* and the surface-to-surface contact between the second prevention surface 45*c* and the second shaking prevention slanting surface 24*c* are effected simultaneously at the time when the inner housing 13 and the female connector housing 42 are completely fitted together, and therefore the effect of preventing the shaking both in the direction perpendicular to the connector fitting direction and in the connector fitting direction is enhanced.

In the connector 10, when the inner housing 13 and the female connector housing 42 are completely fitted together, the first and second prevention surfaces 45*a* and 45*c* are held in firm surface-to-surface contact respectively with the first and second shaking prevention slanting surfaces 24*a* and 24*c* by the resilient forces (that is, the resilient restoring forces) of the coil springs 16, and therefore the effect of preventing the shaking both in the direction perpendicular to the connector fitting direction and in the connector fitting direction is further enhanced.

In the connector 100, when the inner housing 113 and the female connector housing 42 are completely fitted together, the first prevention surface 145*a* and the first shaking prevention slanting surface 124*a* are held in firm surface-to-surface contact with each other by the resilient forces (that is, the resilient restoring forces) of the coil springs 131, and independently of this operation, the second prevention surface 45*c* and the second shaking prevention slanting surface 24*c* are also held in firm surface-to-surface contact with each other by the resilient forces (that is, the resilient restoring forces) of the coil springs 16. Therefore, the shaking both in the direction perpendicular to the connector fitting direction and in the connector fitting direction is positively prevented. And besides, in the connector 100, dimensional tolerances with respect to the distance between the first and second shaking prevention slanting surfaces 124*a* and 24*c* and the distance between the first and second prevention surfaces 145*a* and 45*c* can be made less close, and therefore the female and male connector housings can be molded easily, and also the cost can be reduced.

In the connector 10 (100), the forward withdrawal of the inner housing 13 (113) from the outer housing 12 in the fitting direction by the coil springs 16 is prevented by providing the forward withdrawal prevention mechanism.

In the connector 100, the forward withdrawal of the shaking prevention member 130 from the inner housing 113 in the fitting direction by the coil springs 131 is prevented by providing the first forward withdrawal prevention mechanism, and the forward withdrawal of the inner housing 113 from the outer housing 12 in the fitting direction by the coil springs 16 is prevented by providing the second forward withdrawal prevention mechanism.

In the connector 10 (100), particularly, the female connector housing 42 and the inner housing 13 (113), urged toward the female connector housing 42 by the coil springs 16 (131), can be easily completely fitted together by the connector fitting/disengaging operation-assisting mechanism.

In the connector 10 (100), with the simple construction, the operation for fitting the inner housing 13 (113) and the female connector housing 42 together can be easily assisted, and also the inner housing 13 (113) and the female connector housing 42 can be maintained in the completely-fitted condition, and therefore this is preferred.

In the connector 10 (100), the divided first shaking prevention slanting surface 24*a* (124*a*) is held in surface-to-surface contact with the first prevention surface 45*a* (145*a*) of the female connector housing 42, and/or the divided second shaking prevention slanting surface 24*c* is held in surface-to-surface contact with the second prevention surface 45*c* of the female connector housing 42. For example, in the case where the peripheral wall of the inner housing 13 (113) has the continuous first shaking prevention slanting surface 24*a* (124*a*) (which is not interrupted) and the continuous second shaking prevention slanting surface 24*c* (which is not interrupted), the first and second shaking prevention slanting surfaces 24*a* (124*a*) and 24*c* will not be satisfactorily held in intimate contact with the first and second prevention surfaces 45*a* (145*a*) and 45*c*, respectively, unless the first and second shaking prevention slanting surfaces are precisely formed smoothly over the entire periphery of the peripheral wall, and as a result gaps or clearances, spaced from one another in the peripheral direction, are formed, which leads to a high possibility that an inclination or others develops because of these gaps. However, when the divided first shaking prevention slanting surface 24*a* (124*a*) and the divided second shaking prevention slanting surface 24*c* are brought into abutting engagement with the first and second prevention surfaces 45*a* (145*a*) and 45*c*, respectively, the divided portions of the peripheral wall of the inner housing 13 (113), even if there is a dimensional error, are suitably deformed to absorb this dimensional error, thereby achieving the good surface-to-surface contact, and this good surface-to-surface contact enables the inner housing 13 (113) and the female connector housing 42 to be firmly connected together.

Next, a second embodiment of the present invention will now be described in detail with reference to the drawings.

Figure 7:
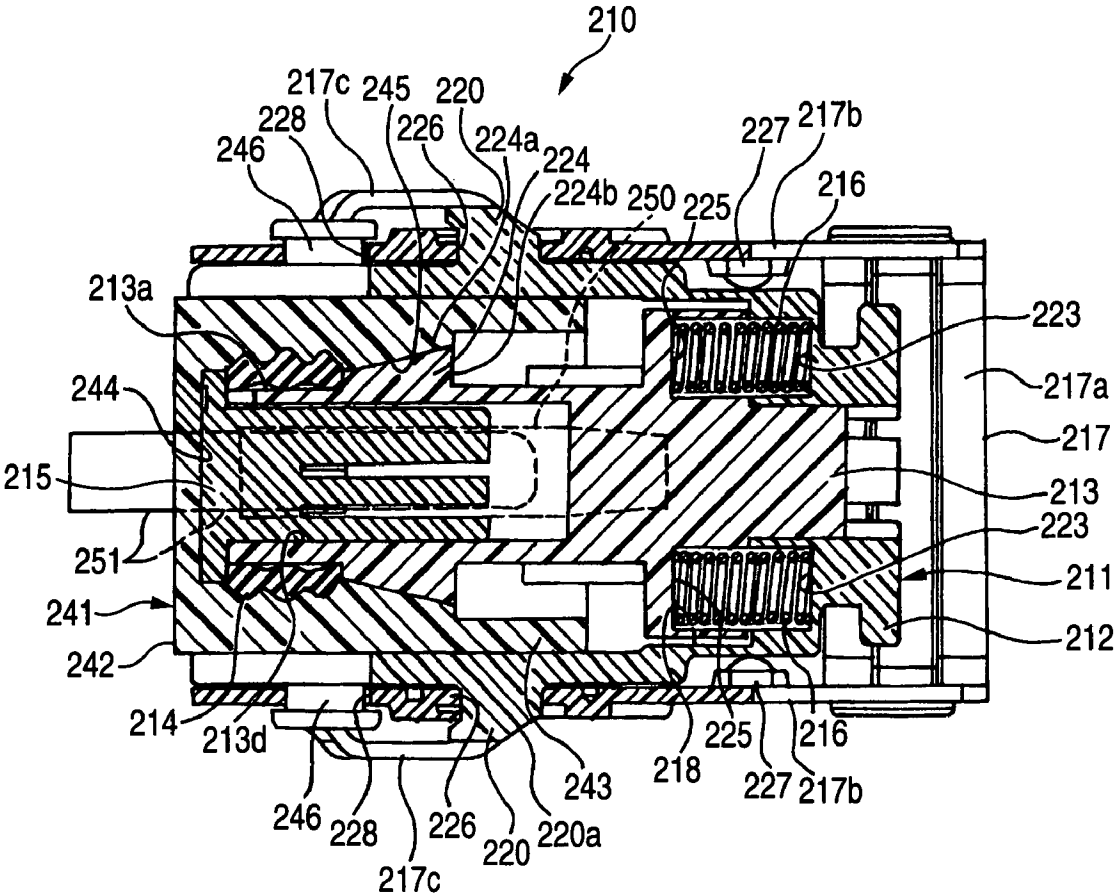
FIG. 7 is a horizontal cross-sectional view of a connector according to a second embodiment of the present invention (i.e., a connector having male and female connectors fitted together.
Figure 8:
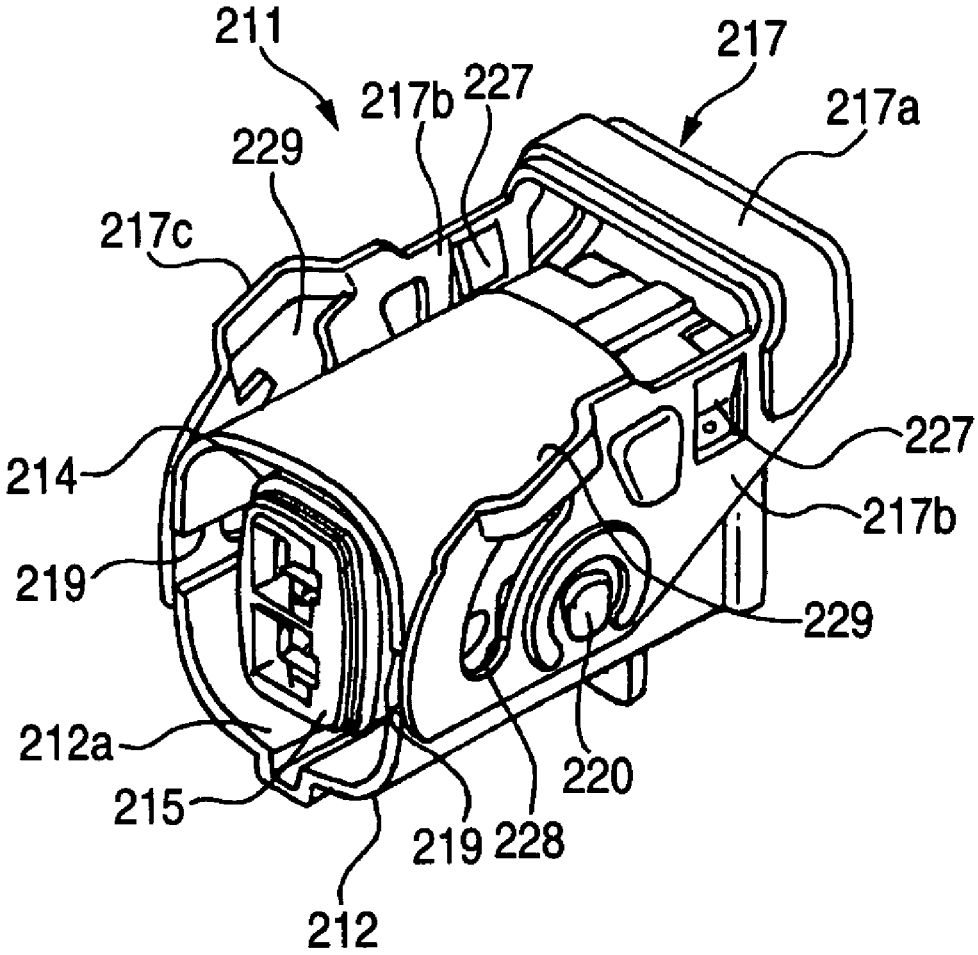
FIG. 8 is a perspective view of the male connector of FIG. 7, showing its appearance (A pivotal lock lever is held in a position where the connector is in a completely-fitted condition)
Figure 9:
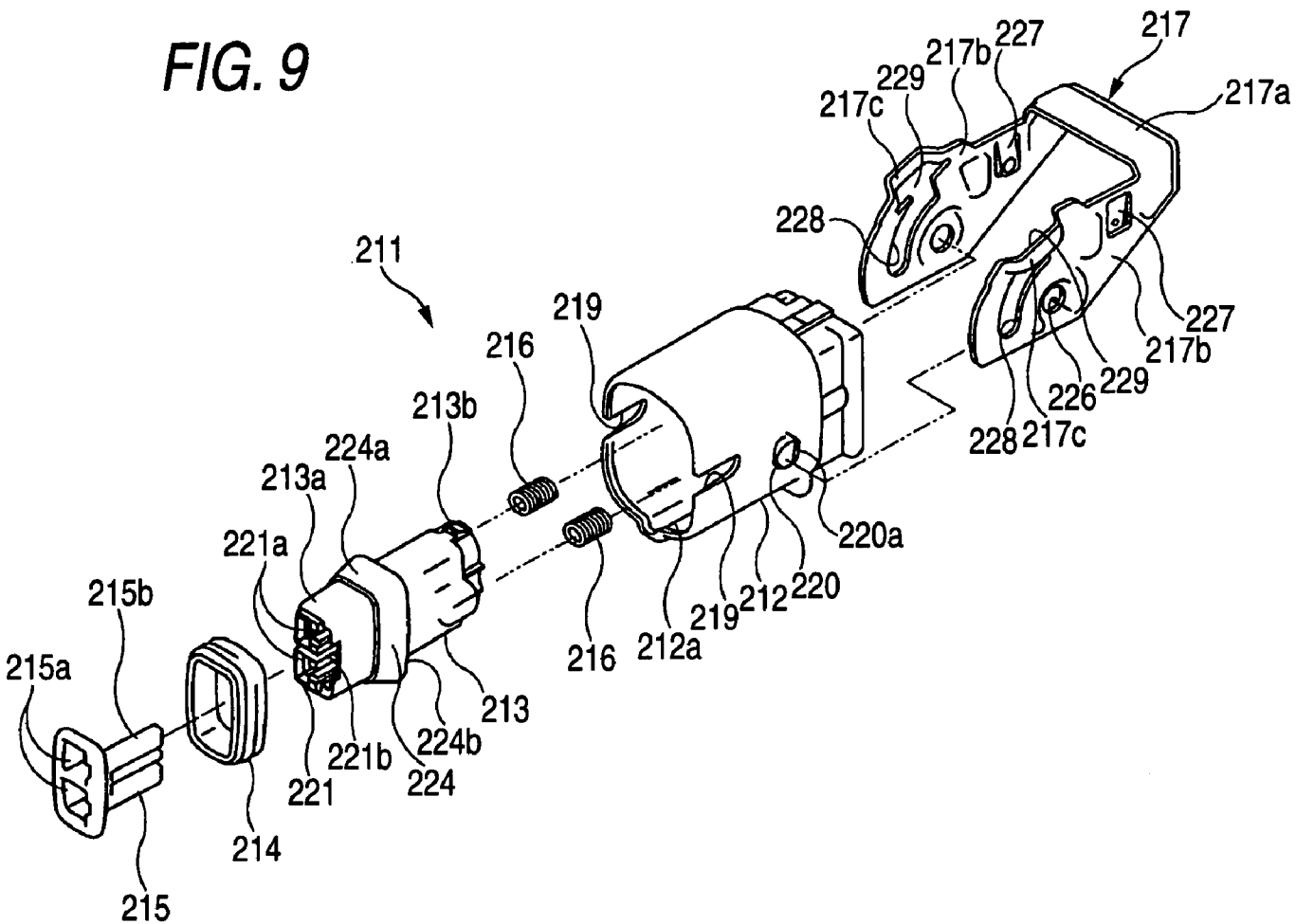
FIG. 9 is an exploded, perspective view of the male connector of FIG. 8.
Figure 10:
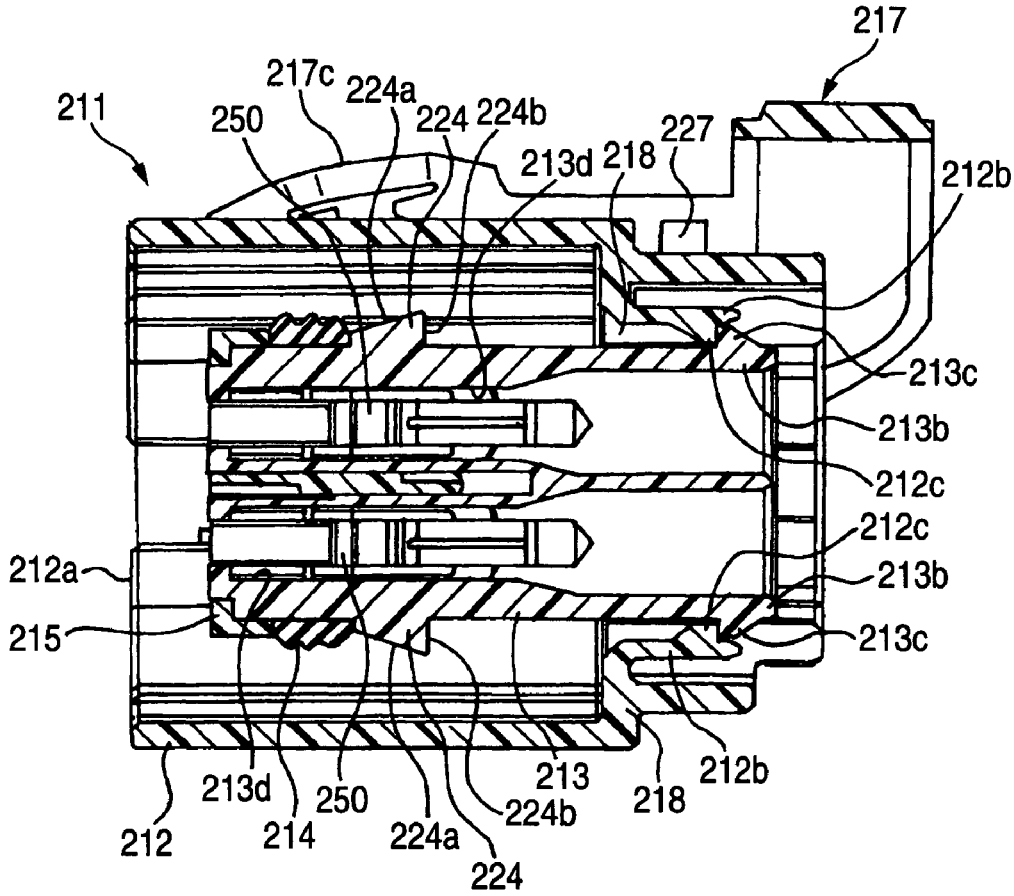
FIG. 10 is a vertical cross-sectional view of the male connector of FIG. 8.

FIG. 7 is a horizontal cross-sectional view of one preferred embodiment of a connector of the present invention (i.e., the connector 210 having male and female connectors 211 and 241 fitted together), FIG. 8 is a perspective view of the male connector 211 of FIG. 7, showing its appearance (A pivotal lock lever 217 is held in a position where the connector 210 is in a completely-fitted condition), FIG. 9 is an exploded, perspective view of the male connector 211 of FIG. 8, and FIG. 10 is a vertical cross-sectional view of the male connector 211 of FIG. 8.

As shown in FIGS. 7 to 10, the connector 210 includes the male connector 211, the female connector 241 for fitting to the male connector 211, and the pivotal lock lover 217 pivotally supported by pivot shafts 220 on the male connector 211 so as to be engaged with the female connector 241. The pivotal lock lever 217 is a connector fitting/disengaging operation-assisting member which cooperates with the pivot shafts 220 and engagement lock projections 246 of the female connector 241 to assist the male and female connectors 211 and 241 in their fitting and disengaging operations so that the male and female connectors 211 and 241 can be easily fitted together and disengaged from each other with a small force. This assisting member can be locked to maintain the male and female connectors 211 and 241 in the completely-fitted condition.

The male connector 211 includes a male connector housing, and more specifically includes an outer housing 212, and an inner housing 213 of the male type supported by the outer housing 212 so as to move in the connector fitting direction within the outer housing 212. The inner housing 213 functions as a terminal receiving portion of the male connector 211, and has two terminal receiving chambers 213*d* formed therein, and two female terminals 250 can be received in these terminal receiving chambers 213*d*, respectively. Each female terminal 250 is provisionally retained by an elastic retaining lance (not shown), and is held in the terminal receiving chamber 213*d*. The male connector 211 further includes an annular waterproof packing 214, a front holder 215 for completely retaining the female terminals 250 respectively in the terminal receiving chambers 213*d* of the inner housing 213, a pair of metal coil springs 216 (one example of resilient members), and the above-mentioned pivotal lock lever 217. On the other hand, the female connector 241 includes a female connector housing 242 holding two male terminals 251 (only one of which is shown) (More specifically, the two male terminals 251 are molded integrally in the female connector housing 242).

Here, for description purposes, the front and rear sides, the upper and lower sides and the left and right sides are defined as follows. The forward-rearward direction is defined as the connector fitting direction, and fitting ends of the male and female connectors 211 and 241 are "the front side", while the opposite ends thereof are "the rear side". The upward-downward direction is defined as the direction of arrangement of the two female terminals 250 and hence the direction of arrangement of the male terminals 251 to which the female terminals can be electrically connected, and "the upper side" is that side (for example, the rear side in FIG. 7, the upper side in FIG. 8 and the upper side in FIG. 10) where an operating portion 217*a* of the pivotal lock lever 217 is disposed, while the opposite side is "the lower side". The left-right direction is the direction of arrangement of the pivot shafts 220 and hence the direction of arrangement of the engagement lock projections 246.

Each of the outer housing 212 and the inner housing 213 is formed by injection molding of a synthetic resin material. The outer housing 212 is formed into a generally oval tubular (or hollow cylindrical) shape, and has an open front side 212*a*. The inner housing 213 is provided within a hollow portion of the outer housing 212 so as to move in the connector fitting direction. As shown in FIGS. 9A and 10, the inner housing 213 has a pair of engagement projection portions 213*b* formed on and extending rearwardly respectively from upper and lower portions of a rear portion of its peripheral wall 213*a* of a generally oval tubular shape in a cantilever-like manner. The upper and lower engagement projection portions 213*b* have respective engagement projections 213*c* projecting upwardly and downwardly respectively from their plate-like bodies. On the other hand, the outer housing 212 has a pair of retaining projection portions 212*b* formed on and extending rearwardly respectively from upper and lower portions of an inner peripheral surface of a housing mounting portion 218 (formed at a rear portion of the outer housing 212) in a cantilever-like manner. The upper and lower retaining projection portions 212*b* have respective retaining projections 212*c* projecting downwardly and upwardly respectively from their plate-like bodies.

The engagement projection portions 213*b* of the inner housing 213 are retained respectively by the retaining projection portions 212*b* within the outer housing 212. More specifically, a front surface of each engagement projection 213*c* engages (abuts against) a rear surface of the corresponding retaining projection 112*c* so as to prevent the forward movement of the inner housing 213 relative to the outer housing 212. Thus, the male connector 211 is provided with a forward-withdrawal prevention mechanism (comprising the engagement projection portions 213*b* and the retaining projection portions 212*b*) for preventing the inner housing 213 from being withdrawn forwardly from the outer housing 213 in the connector fitting direction.

The outer housing 212 has an outer peripheral wall extending forwardly from the housing mounting portion 218 in surrounding relation to the inner housing 213, and this outer peripheral wall functions as a hood for guiding a peripheral wall 243 of the female connector housing 242 of the female connector 241 which is fitted into an annular space formed between the outer housing 212 and the inner housing 213.

As shown in FIG. 9A, slit-like lock projection-receiving portions 219 are formed respectively in opposed left and right portions of the outer peripheral wall of the outer housing 212, and extend in the connector fitting direction. The pivot shafts 220 are formed integrally on the outer surface of the outer peripheral wall of the outer housing 212, and are disposed respectively on lines of extension of the lock projection receiving portions 219. Each pivot shaft 220 has a slanting surface 220*a* slanting inwardly toward the rear side of the outer housing 212. Spring receiving holes 223 for respectively receiving rear end portions of the pair of coil springs 216 are formed respectively in left and right portions of an inner surface of a rear wall of the housing mounting portion 218 of the outer housing 212.

Receiving chamber ports 221*a* are formed in a front side (front surface) 221 of the inner housing 213, and are aligned respectively with male terminal insertion holes 215*a* in the front holder 215. Also, an insertion hole 221*b* is formed in this front side 221, and an insertion portion 215*b* of the front holder 215 is inserted into this insertion hole 221*b*, and is retained therein. The receiving chamber ports 221*a* in the inner housing 213 communicate with the terminal receiving chambers 213*d*, respectively. When the male connector 211 and the female connector 241 are fitted together, an electrical contact portion of each of the male terminals 151 of the female connector 241 is guided into the corresponding terminal receiving chamber 213*d* through the corresponding male terminal insertion hole 215*a* of the front holder 215 and the corresponding receiving chamber port 221*a* of the inner housing 212, and is brought into contact with an electrical contact portion of the corresponding female terminal 250 in the terminal receiving chamber 213*d*, and therefore is electrically connected thereto.

A shaking prevention portion 224 is formed integrally on a front portion of the outer peripheral surface of the peripheral wall 213*a* of the inner housing 213 over the entire periphery thereof (that is, the shaking prevention portion 224 is continuous in the peripheral direction). The shaking prevention portion 224 by itself is in the form of an annular body having an outer shape generally resembling a quadrangular pyramid-shape with rounded four corners. The shaking prevention portion 224 is formed on and projects from the outer peripheral surface of the peripheral wall 213*a* of the inner housing 213. More specifically, the shaking prevention portion 224 includes a slanting surface 224*a* slanting (or tapering) in a manner to approach the axis of the inner housing 213 gradually from the rear side thereof toward the front side thereof, and a vertical surface 224*b* extending from a rear peripheral edge of the slanting surface 224*a* to the peripheral wall 213*a* of the inner housing 213 in a direction perpendicular to the connector fitting direction. When the male connector 211 and the female connector 141 are completely fitted together, the slanting surface 224*a* is held in surface-to-surface contact with a prevention surface 245 formed on an inner peripheral surface of the peripheral wall 243 of the female connector housing 242, as shown in FIG. 7.

Spring receiving holes 225 for respectively receiving the front end portions of the pair of coil springs 216 are formed in the rear end portion of the peripheral wall 213*a* of the inner housing 213, and are disposed to be opposed respectively to the spring receiving holes 223 in the outer housing 212. Opposite side surfaces of the rear portion of the peripheral wall 213*a* of the inner housing 213 are bulged or projected outwardly at their vertically-central portions as shown in FIG. 9, and the spring receiving holes 225 are formed respectively in these bulged portions.

The waterproof packing 214 is molded of synthetic rubber, an elastomeric resin or the like, and is formed into a generally oval tubular (or hollow cylindrical) shape. This waterproof packing 214 is mounted on that surface of the peripheral wall 213*a* of the inner housing 213 disposed at the front side of the shaking prevention portion 224, and is prevented by the front holder 215 from being withdrawn forwardly.

The pivotal lock lever 217 cooperates with the pivot shafts 220 and the engagement lock projections 246 to form a connector fitting/disengaging operation-assisting mechanism, and this pivotal lock lever 217 is made of metal, a synthetic resin or other material. The pivotal lock lever 217 has a generally U-shaped cross-section, and includes the operating portion 217*a*, and side plate portions 217*b* extending generally perpendicularly from opposite (left and right) ends of the operating portion 217*a*, respectively. The pivotal lock lever 217 is mounted on the outer housing 212 in such a manner that the outer housing 212 is disposed between the two side plate portions 217*b*. Each of the side plate portions 217*b* includes a mounting hole 226 in which the corresponding pivot shaft 220 of the outer housing 212 is rotatably engaged, a spring plate portion 227 resiliently held against the side surface of the outer housing 212, and a lock groove 228 of an arcuate shape. Each of the lock grooves 228 is open at its one longitudinal end so that the engagement lock projections 246, formed respectively on the left and right side surfaces of the peripheral wall 243 of the female connector housing 241, can be easily introduced into the lock grooves 228, respectively. More specifically, in order that the engagement lock projection 246 can be easily introduced into the lock groove 228, part 217*c* of each side plate portion 217*b* is bulged outwardly to form a lock projection-introducing port 229 which communicates with the open end of the lock groove 228.

The female connector housing 242 of the female connector 241 has a connector fitting chamber 244 (of a tubular shape with a closed bottom) formed by the inner peripheral surface of the peripheral wall 243, the connector fitting chamber 244 being open at its front side. The inner peripheral surface of the connector fitting chamber 244, formed by the peripheral wall 243, has the prevention surface 245 of a tapering shape slanting (or tapering) in a manner to approach the axis of the female connector housing 242 gradually from the front side thereof toward the rear side thereof. When the male connector 211 and the female connectors 241 are fitted together, the prevention surface abuts against the slanting surface 224*a* of the shaking prevention portion 224 of the male connector 211, and this prevention surface 245 is formed on the peripheral wall 243 of the connector fitting chamber 244 at the same slanting angle as that of the slanting surface 224*a*.

Next, a method of assembling the male connector 211 will be described. With respect to the female connector 241, the female connector housing 242 can be formed (molded), with the male terminals 251 insert-molded therein, and therefore detailed description of its assembling method is omitted. However, there can be used a construction in which suitable terminal receiving chambers are formed within the female connector housing 242, and the male terminals 251 are retained by suitable retaining member (such as elastic retaining lances) within the respective terminal receiving chambers.

The male connector 211 is assembled as follows. The waterproof packing 214 is mounted on the front portion of the peripheral wall 213*a* of the inner housing 213 having the female terminals 250 received respectively within the terminal receiving chambers 213*d*. Then, the insertion portion 215*b* of the front holder 215 is inserted into the insertion hole 221*b* in the inner housing 213, so that the front holder 215 is mounted in the inner housing 213. As a result of mounting the front holder 215 in the inner housing 213, the female terminals 250 are retained in a double manner within the respective terminal receiving chambers 213*d*, and also the waterproof packing 214 is prevented from being withdrawn forwardly from the inner housing 213.

Then, the front end portions of the coil springs 216 are inserted respectively into the spring receiving holes 225 from the rear side of the inner housing 213, with the rear end portions of the coil springs 216 projecting respectively from the spring receiving holes 225, and in this condition the inner housing 213 is fitted into the housing mounting portion 218 of the outer housing 212 while the rear end portions of the coil springs 216 are inserted respectively into the spring receiving holes 223 in the outer housing 212.

The inner housing 213 is pushed deep into the housing mounting portion 218 toward the inner end thereof against resilient forces (that is, resilient restoring forces) of the coil springs 216, and when the engagement projection portions

213*b* of the inner housing 213 are brought into engagement with the retaining projection portions 212*b* of the outer housing 212, respectively, the coil springs 216 are held between the inner housing 213 and the outer housing 212. In this manner, the inner housing 213 and the outer housing 212 are combined or assembled together. In this completely-assembled condition of the inner and outer housings 213 and 212, the coil springs 216 may or may not be compressed between the inner and outer housings 213 and 212.

Then, the pivotal lock lever 217 is brought close to the rear side of the outer housing 212, and as the outer housing 213 is inserted between the pair of side plate portions 217*b* of the pivotal lock lever 217 to be disposed therebetween, end edges of the side plate portions 217*b* are brought into abutting engagement with the slanting surfaces 220*a* of the pivot shafts 220, respectively, and then the side plate portions 217*b* are temporarily deformed outwardly away from each other, and when the mounting holes 226 are brought into alignment with the left and right pivot shafts 220, respectively, the pivot shafts 220 become engaged in the mounting holes 226, respectively. In this manner, the pivotal lock lever 217 is mounted on the outer housing 212, thus completing the assembling of the male connector 211.

In this manner, the pivotal lock lever 217 is mounted on the outer housing 212 so as to be pivotally moved about the pivot shafts 220 in the forward and rearward directions, and particularly the pivotal lock lever 217 can be switched (or moved) between an unlocked position (shown in FIG. 11A) where the pivotal lock lever 217 is held in an upstanding condition, with the operating portion 217*a* disposed generally perpendicular to the upper surface of the outer housing 212 and a locked position (shown in FIGS. 7, 8, 10 and 11B) where the pivotal lock lever 217 is laid flat rearwardly, with the operating portion 217*a* disposed generally horizontally in generally parallel relation to the upper surface of the outer housing 212.

Figure 11A:
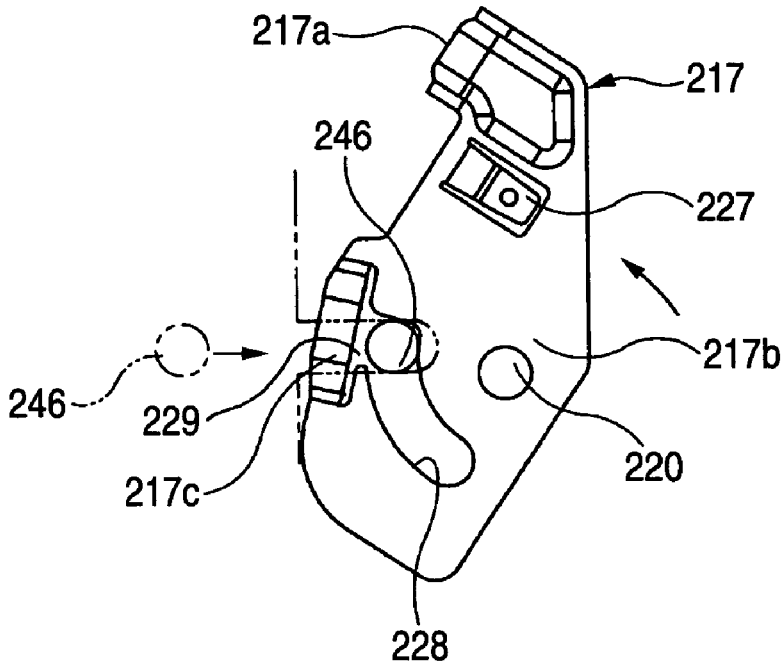
FIGS. 11A and 11B are views explanatory of a locking operation achieved by a connector fitting/disengaging operation-assisting mechanism of the connector of FIG. 7.
Figure 11B:
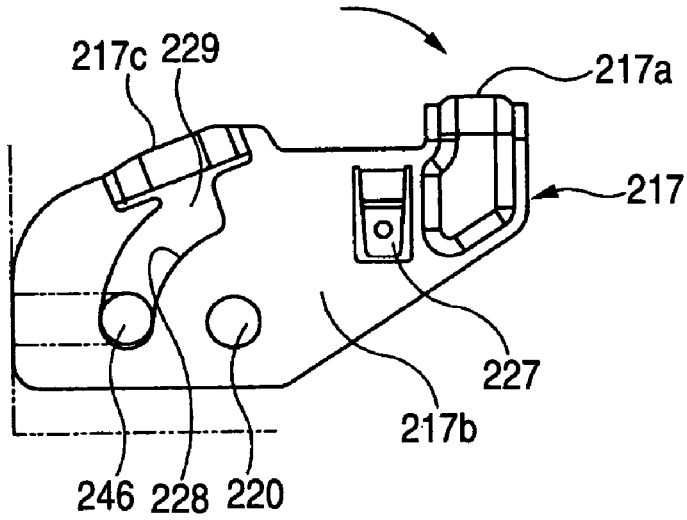

FIGS. 11A and 11B are views explanatory of a locking operation of the connector fitting/disengaging operation-assisting mechanism (including the pivotal lock lever 217, the pivot shafts 220 and the engagement lock projections 246) of the connector of FIG. 7. As is clear from FIG. 11A, when the pivotal lock lever 217 is located in the unlocked position where it is disposed in the upstanding condition, each lock projection-introducing port 229 is open forwardly, that is, toward the female connector housing 242 at the time of starting the operation for fitting the male and female connectors 211 and 241 together.

Next, a method of fitting the connector 210 will be described.

The pivotal lock lever 217 of the male connector 211 is held in the unlocked position as shown in FIG. 11A, and in this condition when the peripheral wall 243 of the female connector housing 242 is fitted into the annular space between the outer housing 212 and the inner housing 213, the inner housing 213 is also fitted into the connector fitting chamber 244 of the female connector housing 242. At this time, each engagement lock projection 246 of the female connector housing 242 enters the corresponding lock projection receiving portion 219 of the outer housing 212, and then passes through the lock projection-introducing port 229, and is disposed in the open end of the lock groove 228. FIG. 11A shows this condition in which the male connector 211 and the female connector 241 are in a half-fitted condition.

Then, when the operating portion 217*a* is pushed rearwardly to pivotally move the pivotal lock lever 217 about the pivot shafts 220 rearwardly from the unlocked position (FIG. 11A) toward the locked position, each engagement lock projection 246, while guided by the corresponding lock groove 228, moves along this lock groove 228 from the one end thereof toward the other end thereof, so that the operation for fitting the male and female connectors 211 and 241 together proceeds. At this time, the prevention surface 245, disposed close to the inner end of the connector fitting chamber 244, abuts, against the slanting surface 224*a* of the shaking prevention portion 224 of the inner housing 213. In this condition, when the operating portion 217*a* is further pushed rearwardly to pivotally move the pivotal lock lever 217 into the locked position (FIG. 11B), the male connector 211 and the female connector 241 are completely fitted together, and also, within these connectors, the slanting surface 224*a* is pressed by the prevention surface 245, so that the coil springs 216 are compressed.

In this connector completely-fitted condition, the male connector 211 and the female connector 241 are locked against disengagement from each other by the connector fitting/disengaging operation-assisting mechanism comprising the pivotal lock lever 217 and so on, and this fitted condition is maintained. Therefore, the prevention surface 245 of the female connector housing 242 is urged by the resilient restoring forces of the coil springs 216 via the slanting surface 224*a* of the shaking prevention portion 224, and therefore is held in intimate contact with the slanting surface 224*a* (In other words, the slanting surface 224*a* is held in surface-to-surface contact with the prevention surface 245, and is kept pressed against the prevention surface 245 by the resilient restoring forces of the coil springs 216). In this connector completely-fitted condition, the flat plate-like electrical contact portion of each of the male terminals 251 is inserted in the box-like electrical contact portion of the corresponding female terminal 250 as shown in FIG. 7, so that the electrical contact portions of the female and male terminals 250 and 251 are electrically connected together. In this connector completely-fitted condition, the waterproof packing 214 is held between the inner peripheral surface of the connector fitting chamber 244 of the female connector housing 242 and the outer peripheral surface of the peripheral wall 213*a* of the inner housing 213, and forms a liquid-tight seal between the inner peripheral surface and the outer peripheral surface as shown in FIG. 7. The operation for disengaging the male connector 211 and the female connector 241 from each other is effected by pivotally moving the pivotal lock lever 217 in a direction opposite to the above-mentioned direction.

The present invention is not limited to the above embodiment, and suitable modifications, improvements and so on can be made. And, the material, shape, dimensions, numerical value, form, number, disposition, etc., of each of the constituent elements of the above embodiment are arbitrary, and are not limited in so far as the invention can be achieved.

Figure 12:
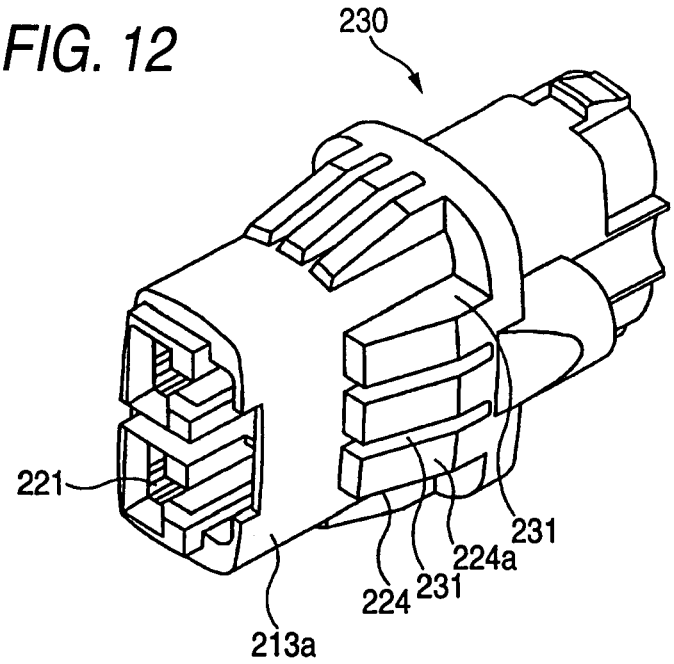
FIG. 12 is a perspective view showing a modified inner housing of the connector of the second embodiment of the invention.
Figure 13:
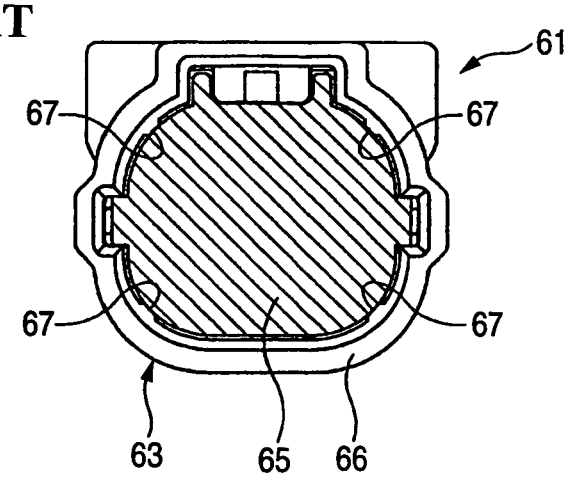
FIG. 13 PRIOR ART
FIG. 13 is a cross-sectional view roughly showing a related connector in a completely-fitted condition.
Figure 14:
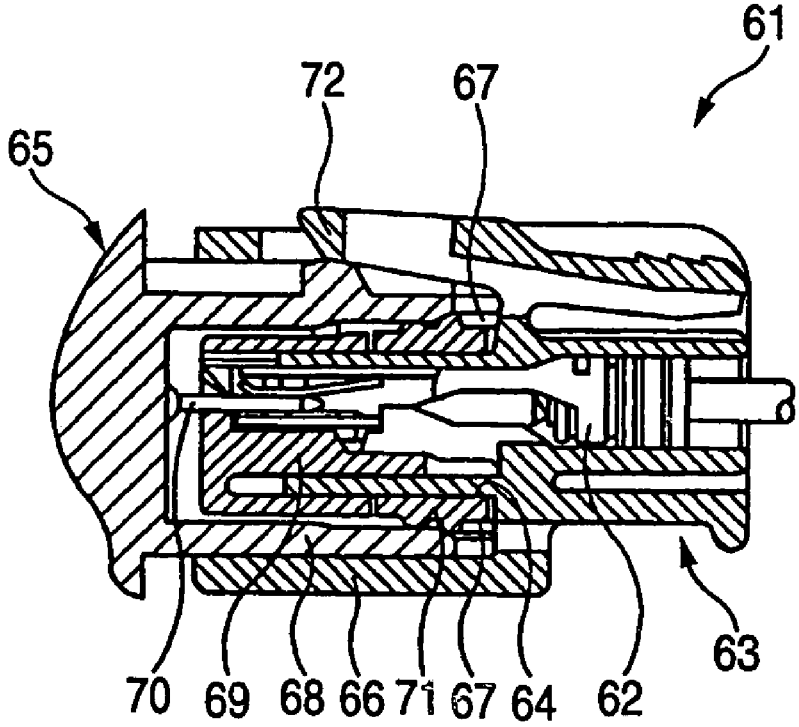
FIG. 14 PRIOR ART
FIG. 14 is a vertical cross-sectional view of the connector of FIG. 13, showing a condition immediately before the completely-fitted condition.

For example, the shaking prevention portion 224 of the inner housing 213 can be modified into a shaking prevention portion 224 of an inner housing 230 shown in FIG. 12. More specifically, a plurality of slits 231, which extend in a connector fitting direction, and are spaced from one anther in a peripheral direction, can be formed in the shaking prevention portion 224 of the inner housing 230 to divide a slanting surface 224*a* into a plurality of sections.

The following is the brief description of the features of the connector according to the second embodiment.

The connector 210 comprises:

a female connector housing 242 holding a male terminal 251;

a male inner housing 213 which holds a female terminal 250 for electrical connection to the male terminal 251, and can be fitted in the female connector housing 242 such that the female terminal 250 is connected to the male terminal 251;

an outer housing 212 holding the inner housing 213 in such a manner that the inner housing 213 can be moved in a direction of fitting of the inner housing 213 and the female connector housing 242;

a shaking prevention portion 224 which is formed on an outer peripheral surface of the inner housing 213, and has a slanting surface 224*a;* a connector fitting chamber 244 formed in the female connector housing 242 so as to receive the inner housing 213 therein when the inner housing 213 and the female connector housing 242 are fitted together;

a prevention surface 245 which is formed on an inner peripheral surface of the connector fitting chamber 244 so as to be held in surface-to-surface contact with the slanting surface 224*a*; and a metal coil spring 216 which is provided between the inner housing 213 and the outer housing 212, and urges the inner housing 213 in the direction of fitting of the inner housing 213 into the female connector housing 242 by its resilient force so that when the inner housing 213 and the female connector housing 242 are completely fitted together, the slanting surface 224*a* can be pressed against the prevention surface 245 in surface-to-surface contacting relation thereto.

In the connector 210, the connector 210 further comprises a forward withdrawal prevention mechanism provided between the inner housing 213 and the outer housing 212, and the forward withdrawal prevention mechanism prevents the inner housing 213 from being withdrawn forwardly from the outer housing 212 in the fitting direction by the coil spring.

In the connector 210, the connector 210 further comprises a connector fitting/disengaging operation-assisting mechanism which assists the inner housing 213 and the female connector housing 242 in their fitting operation, and can maintain the inner housing 213 and the female connector housing 242 in the completely-fitted condition.

In the connector 210, the connector fitting/disengaging operation-assisting mechanism includes:

a pair of engagement lock projections 246 which are formed respectively on opposite side portions of an outer peripheral surface of the female connector housing 242, and are spaced from each other in a direction perpendicular to the fitting direction;

a pair of pivot shafts 220 which are formed respectively on opposite side portions of an outer peripheral surface of the outer housing 212, and are spaced from each other in the direction perpendicular to the fitting direction; and a pivotal lock lever 217 mounted on the pivot shafts 220 so as to be pivotally moved about the pivot shafts 220; and the pivotal lock lever 217 has a pair of lock grooves 228 of an arcuate shape for respectively receiving the engagement lock projections 246 so as to guide these projections 246, and when the pivotal lock lever 217 is pivotally moved, the engagement lock projections 246 are guided by the respective lock grooves 228, so that the inner housing 213 and the female connector housing 242 are fitted together or are disengaged from each other.

In the connector 210, a plurality of slits 231, extending in the fitting direction, and are spaced from one anther in the peripheral direction, are formed in the shaking prevention portion 224 to divide the slanting surface 224*a* on the inner housing (230) into a plurality of sections.

As described above, in the connector 210, when the inner housing 213 (which is part of the male connector housing) and the female connector housing 242 are completely fitted together, the prevention surface 245 is held in firm surface-to-surface contact with the slanting surface 224*a* of the shaking prevention portion 224 by the resilient forces (that is, the resilient restoring forces) of the coil springs 216, and therefore the shaking (shaking movement) both in the direction perpendicular to the connector fitting direction and in the connector fitting direction is prevented. Therefore, wear, etc., of the electrical contact portions of the female and male terminals 250 and 251 are positively prevented. The connector 210 is provided with the metal coil springs 216 which are less susceptible to aged deterioration and characteristics deterioration due to heat and others, and tend to have a smaller amount of permanent set in fatigue as compared with resilient members molded of synthetic resin, an elastomeric resin or the like. Therefore, the connector 210 is excellent in this respect.

In the connector 210, the forward withdrawal of the inner housing 213 from the outer housing 212 in the fitting direction by the coil springs 216 (having the high resilient force) is prevented by providing the forward withdrawal prevention mechanism.

In the connector 210, particularly, the female connector housing 242 and the inner housing 213, urged toward the female connector housing 242 by the coil springs 216, can be easily completely fitted together by the connector fitting/disengaging operation-assisting mechanism.

In the connector 210, with the simple construction, the operation for fitting the inner housing 213 and the female connector housing 242 together can be easily assisted, and also the inner housing 213 and the female connector housing 242 can be maintained in the completely-fitted condition, and therefore this is preferred.

In the connector 210, the division sections of the slanting surface 224*a* of the divided shaking prevention portion 224 are held in surface-to-surface contact with the prevention surface 245 of the female connector housing 242. For example, in the case where the shaking prevention portion 224 has the continuous slanting surface 224*a*, the slanting surface 224*a* will not be satisfactorily held in intimate contact with the prevention surface 245 unless this slanting surface 224*a* is precisely formed smoothly over the entire periphery of the peripheral wall, and as a result gaps or clearances, spaced from one another in the peripheral direction, are formed, which leads to a high possibility that an inclination or others develops because of these gaps. However, when the division sections of the slanting surface 224*a* of the divided shaking prevention portion 224 are brought into abutting engagement with the prevention surface 245 of the female connector housing 242, the sections of the divided shaking prevention portion 224, even if there is a dimensional error, are suitably deformed to absorb this dimensional error, thereby achieving the good surface-to-surface contact, and this good surface-to-surface contact enables the inner housing 230 and the female connector housing 242 to be firmly connected together.

What is claimed is:

1. A connector, comprising:

a connector housing that has a first terminal receiving opening for receiving a first terminal; and an inner housing that has a second terminal receiving opening for receiving a second terminal, said inner housing being configured to be fitted into the connector housing so that the second terminal is connected to the first terminal; and wherein a first slanting face is formed on an outer peripheral face of the inner housing;

wherein the connector housing has a chamber for receiving the inner housing therein when the inner housing is fitted into the connector housing;

wherein a first prevention face is formed on an inner peripheral face of the chamber;

wherein the first slanting face is surface-contacted with the first prevention face when the inner housing is completely fitted into the connector housing; and wherein said first slanting face and said first prevention face are inclined with respect to a longitudinal axis of the connector.

2. The connector as set forth in claim 1, further comprising:

an outer housing that holds the inner housing so that the inner housing is movable in a fitting direction of the inner housing and the connector housing; and a first resilient member that is provided between the inner housing and the outer housing, and urges the inner housing in the fitting direction by a resilient force of the first resilient member so that the first slanting face is pressed against the first prevention face when the inner housing is completely fitted into the connector housing.

3. The connector as set forth in claim 1, wherein a second slanting face is formed on the outer peripheral face of the inner housing so that the second slanting face and the first slanting face are arranged in a fitting direction of the inner housing and the connector housing;

wherein a second prevention face is formed on the inner peripheral face of the chamber so that the second prevention face and the first prevention face are arranged in the fitting direction;

wherein when the inner housing is completely fitted into the connector housing, the first slanting face is surface-contacted with the first prevention face, while the second slanting face is surface-contacted with the second prevention face; and wherein the second slanting face and second prevention face are inclined with respect to the longitudinal axis.

4. The connector as set forth in claim 3, wherein the surface contact between the first slanting face and the first prevention face and the surface contact between the second slanting face and the second prevention face are performed simultaneously at the time when the inner housing is completely fitted into the connector housing.

5. The connector as set forth in claim 3, further comprising an outer housing that holds the inner housing so that the inner housing is movable in the fitting direction; and a first resilient member that is provided between the inner housing and the outer housing, and urges the inner housing in the fitting direction by a resilient force of the first resilient member so that the first slanting face is pressed against the first prevention face and the second slanting face is pressed against the second prevention face when the inner housing is completely fitted into the connector housing.

6. The connector as set forth in claim 3, wherein a slanting degree of the second slanting face is greater than that of the first slanting face.

7. The connector as set forth in claim 3, wherein the inner housing includes an annular shaking prevention member which is provided on a peripheral wall of the inner housing so as to slidable on the inner housing in the fitting direction;

wherein the shaking prevention member has the first slanting face on an outer peripheral face thereof; and wherein a second resilient member is provided on the inner housing, and urges the shaking prevention member in the fitting direction by a resilient force of the second resilient member so as to press the first slanting face against the first prevention face when the inner housing is completely fitted into the connector housing.

8. The connector as set forth in claim 1, further comprising a connector assisting mechanism that assists a fitting operation of the inner housing and the connector housing, and maintains the inner housing and the connector housing in the completely-fitted condition.

9. The connector as set forth in claim 8, wherein the assisting mechanism includes:

a pair of engagement lock projections that are formed respectively on opposite side portions of an outer peripheral face of the connector housing, and are spaced from each other in a direction perpendicular to the fitting direction;

a pair of pivot shafts that are formed respectively on opposite side portions of an outer peripheral face of the outer housing, and are spaced from each other in the direction perpendicular to the fitting direction; and a pivotal lock lever that is provided on the pivot shafts so as to be pivotally moved about the pivot shafts;

wherein the pivotal lock lever has a pair of lock grooves having an arcuate shape for respectively receiving the engagement lock projections so as to guide the engagement lock projections; and wherein when the pivotal lock lever is pivotally moved, the engagement lock projections are guided by the respective lock grooves so that the inner housing and the connector housing are fitted together or are disengaged from each other.

10. The connector as set forth in claim 2, further comprising a forward withdrawal prevention mechanism that is provided between the inner housing and the outer housing, wherein the forward withdrawal prevention mechanism prevents the inner housing from being withdrawn forwardly from the outer housing in the fitting direction by the first resilient member.

11. The connector as set forth in claim 1, wherein the first slanting face has a plurality of slanting face portions which are divided by a plurality of slits; and wherein the slits extend in the fitting direction, and are spaced from one another in a peripheral direction of the outer peripheral face of the inner housing.

12. The connector as set forth in claim 3, wherein at least one of the first slanting face and the second slanting face has a plurality of slanting face portions which are divided by a plurality of slits; and wherein the slits extend in the fitting direction, and are spaced from one another in a peripheral direction of the outer peripheral face of the inner housing.

13. The connector as set forth in claim 7, wherein the first slanting face has a plurality of slanting face portions which are divided by a plurality of slits; and wherein the slits extend in the fitting direction, and are spaced from one another in a peripheral direction of the outer peripheral face of the inner housing.

* * * * *